US012414584B2

(12) United States Patent
Tuttle

(10) Patent No.: US 12,414,584 B2
(45) Date of Patent: Sep. 16, 2025

(54) METHOD AND APPARATUS PRE-ROLLED CONE FILLING, PACKING, FINISHING, AND EXTRUDING

(71) Applicant: Wesley D. Tuttle, Spokane Valley, WA (US)

(72) Inventor: Wesley D. Tuttle, Spokane Valley, WA (US)

(73) Assignee: PREROLL PRESS INC., Spokane Valley, WA (US)

( * ) Notice: Subject to any disclaimer, the term of this patent is extended or adjusted under 35 U.S.C. 154(b) by 1069 days.

(21) Appl. No.: 17/111,503

(22) Filed: Dec. 3, 2020

(65) Prior Publication Data

US 2022/0175019 A1 Jun. 9, 2022

(51) Int. Cl.

| | |
|---|---|
| ***A24C 5/06*** | (2006.01) |
| ***A24C 5/40*** | (2006.01) |
| ***A24C 5/54*** | (2006.01) |
| ***A24D 1/18*** | (2006.01) |

(52) U.S. Cl.

CPC ..... *A24C 5/06* (2013.01); *A24C 5/40* (2013.01); *A24C 5/54* (2013.01); *A24D 1/18* (2013.01)

(58) Field of Classification Search

CPC .... A24C 5/06; A24C 5/40; A24C 5/42; A24C 5/54

USPC ..... 131/70, 73

See application file for complete search history.

(56) References Cited

U.S. PATENT DOCUMENTS

| | | | | |
|---|---|---|---|---|
| 4,832,057 | A * | 5/1989 | Bale | A24C 5/40 131/365 |
| 10,604,292 | B1 * | 3/2020 | Dodson | B65B 39/06 |
| 2019/0059439 | A1 * | 2/2019 | Richmond | A24C 5/42 |
| 2019/0320709 | A1 * | 10/2019 | Kaufmann | A24C 5/06 |

OTHER PUBLICATIONS

A&S Novelties, Buddies Bump Box Cone Filling Machine for 109mm Pre-Rolled Cones, posted at amazon.com, © 1996-2021, Amazon.com, Inc. or its affiliates, [online], [site visited Aug. 19, 2021], date first available: Jul. 9, 2018, 7 pages, available from Internet, <URL: https://www.amazon.com/Buddies-Filling-Machine-109mm-Pre-Rolled/dp/B07FCQRLV3>.

(Continued)

*Primary Examiner* — Philip Y Louie
*Assistant Examiner* — Yana B Krinker
(74) *Attorney, Agent, or Firm* — Howard Russell

(57) ABSTRACT

A pre-rolled cone filling, packing, finishing, and extruding apparatus and methods adapted for making and extruding cigarettes, such as marijuana cigarettes, onto a catcher and applications thereof are presented. In one embodiment, an apparatus is comprised of a plate with a working surface, a rim portion, a plurality of tapered holes that hold pre-rolled cones, a base attached to the plate, a packing and crimping device with thin rods that fill, pack and crimp pre-rolled cones, and a closing and extruding device with tubes that close and extrude finished cigarettes. A method involves placing pre-rolled cones into the apparatus, pouring the filling material onto the plate and shaking it; inserting the thin rod of the packing and crimping device and moving it to pack and crimp the pre-rolled cone; inserting the tube of the closing and extruding device and closing and extruding the finished cigarettes out onto the catcher.

18 Claims, 15 Drawing Sheets

(56) References Cited

OTHER PUBLICATIONS

Mountainhighcones, Coolbox, Aug. 10, 2012, https://www.youtube.com/watch?v=fG14qPYv6Xw (Year: 2012).

smokecones.com, Cones 70mm Pre Roll Filling Device For Use With Electric Vibrating Base, posted at smokecones.com, Copyright 2021 Smokecones.com, [online], [site visited Aug. 19, 2021], pre 2016, 3 pages, available from Internet, <URL: https://www.smokecones.com/Cones-70mm-Pre-Roll-Filling-Device-For-Use-With-Electric-Vibrating-Base_p_107.html>.

Custom Cones USA, Automated Pre-Roll Machine | Custom Cones USA, Feb. 28, 2020, https://www.youtube.com/watch?v=Afe69HkmWOg (Year: 2020).

Custom Cones USA, Industrial Cone Packer 300, posted at customconesusa.com, © 2021 Custom Cones USA, [online], [site visited Aug. 20, 2021], Aug. 19, 2019, 6 pages, available from Internet, <URL: https://customconesusa.com/industrial-cone-packer-300/>.

Doob Cube, Doob Cube, posted at facebook.com, [online], [site visited Aug. 20, 2021], Mar. 2, 2019, 2 pages, available from Internet, <URL: https://www.facebook.com/thedoobcube>.

Demeter's Workshop, DW's Black Cone Tender 6 Shooter Cone Loader 1¼" Detachable Kief Catcher Roll, posted at demetersworkshop.com, Copyright © 2019 Demeter's Workshop, [online], [site visited Aug. 20, 2021], 2019, 2 pages, available from Internet, <URL: https://demetersworkshop.com/shop/ols/categories/cone-tender---cone-loaders>.

Mastahrolla, Rolling a joint with a rolling machine—Elements brand-single skin, Apr. 26, 2011, https://www.youtube.com/watch?v=a3ZdRwE0aMQ (Year: 2011).

Futurolausa, Futurola Knockbox 100 New Video!, Sep. 6, 2016, https://www.youtube.com/watch?v=NdqD_OS4RsA (Year: 2016).

Humboldt Cone Filling Machines, Humboldt Cone Filling Machine Starter Kit for 109mm, 1 Gram, King Size Pre-Rolled Cones (315X), posted at amazon.com, © 1996-2021, Amazon.com, Inc. or its affiliates, [online], [site visited Oct. 29, 2021], date first available: Jun. 24, 2020, pages, available from Internet, <URL: https://www.amazon.com/Humboldt-Filling-Machine-Starter-Pre-Rolled/dp/B08BTM543J/ref=sr_1_2?dchild=1&keywords=humboldt+cones&qid=1626643974&sr=8-2.

* cited by examiner

METHOD AND APPARATUS PRE-ROLLED CONE FILLING, PACKING, FINISHING, AND EXTRUDING

CONTINUITY AND CLAIM OF PRIORITY

This is an original U.S. non-provisional patent application.

FIELD

The invention relates to methods and apparatus for making cigarettes, and more particularly, the invention relates to methods and apparatus for packing, finishing, and extruding pre-rolled cones into marijuana cigarettes.

BACKGROUND

In the past, there have been many ways smokable plant-based materials, the most common of which is tobacco, have been prepared for human consumption by way of smoking a cigarette. Due to a widespread consumption of tobacco as cigarettes, there have been many automated machines that mass produce cigarettes of various kinds, most of which are cylinder-shaped.

However, as marijuana use and production have become variously legalized in various states across the United States, and to a degree federally in accordance with the 2018 Farm Bill, there has been an increased interest in preparation of marijuana plant materials for smoking. Thus, as more widespread interest in marijuana cigarettes has increased, there has been a need for quick and easy methods of marijuana cigarette production. Automated cigarette machines are not fit for this purpose, since marijuana has more resin and is therefore stickier than tobacco, and it cannot be produced by current automated machines that are designed to produce tobacco cigarettes.

Therefore, various inventions and methods have been proposed for preparing marijuana for consumption. For example, U.S. Pat. No. 10,806,173 B2, Method and Apparatus for Custom Rolling a Smokable Product, to Tully, shows a system using a mandrill that assists in rolling smokable material that is subsequently removed into the rolled cylindrical cigarette. However, the Tully patent allows only for one at a time making of cylindrical cigarettes. To overcome this limitation and as pre-rolled cones have become popular, other methods and devices have been proposed for preparing different shaped and sized cigarettes.

For example, U.S. Pat. No. 10,647,529 B2, Packing Device for Consumable Materials, to Busnardo, defines a portable packing device for consumable materials having an outer sleeve and a telescoping inner sleeve which is spring loaded, allowing the user to press the protruding upper portion of the inner sleeve, creating tension and vibration needed to compress the consumable materials into a pre-rolled cone. Similarly, published patent application US 2017/0119043, Apparatus for Filling and Packing Pre-Formed Conical Cigarette Wrappers, to Swanson, describes a conical cigarette wrapper along with a one-at-a-time holder with a tamping surface attached to a shaft. Further, published patent application US 2014/0182604, Device and Method for Manufacturing Tobacco Products, to Hutton, shows a primarily cylindrical plastic tube for use in manufacture of smoking products with various diameters and geometries, and with a removable-top funnel with a segmented cylinder for removal of the final product. There are also automated machines that are known in the art that prepare marijuana cigarettes either as cylindrical or conical cigarettes.

While the above-mentioned inventions have overcome the problem of stickiness of marijuana and the need for the ability to accommodate differently-shaped and differently-sized cigarettes, these devices are either expensive automated commercial machines or a device that may only accommodate and produce one cigarette at time. Therefore, a cheaper, single-operator machine that allows for all steps of filling, packing, crimping, closing, and extruding of multiple marijuana cigarettes at the same time is needed. Such a machine would ideally allow an individual to manufacture multiple marijuana cigarettes quickly and efficiently. Further, the size and the ease of use of such a machine apparatus would give advantage over other much larger mass production machines in the industry. Still further, such a machine would fill, pack, crimp, close and extrude one or more marijuana cigarettes using a single multi-part apparatus, allowing for quick and easy use at home and at low cost.

SUMMARY

In accordance with an aspect and embodiment of the disclosure, a pre-rolled cone filling, packing, finishing, and extruding apparatus (also referred to herein as a "cigarette manufacturing apparatus" or "the apparatus") is adapted for making and extruding cigarettes such as marijuana cigarettes onto a catcher, such as a table, a floor, a bucket, or other catching device. The pre-rolled cone filling, packing, finishing, and extruding apparatus comprises a plate having a working surface and a rim portion. The plate defines at least one tapered hole communicating with the working surface, and each tapered hole is wider where it communicates with the working surface of the plate than it is where it communicates with the final extrusion surface of the plate. The plate is adapted to receive and hold a pre-rolled cone into each tapered hole. A base is attached to the plate. The base is adapted for holding the plate sufficiently spaced from the catcher, such as a table surface. The sufficient space between the plate and the catcher allows each pre-rolled cone received by each tapered hole to be suspended above the catcher to allow for extruding of a finished cigarette. The pre-rolled cone filling, packing, finishing, and extruding apparatus further comprises a packing and crimping device and a closing and extruding device. The packing and crimping device comprises a handle having at least one thin rod attached to the handle. The packing and crimping device is adapted to pack and crimp each pre-rolled cone within each tapered hole of the plate. The closing and extruding device comprises a handle having at least one tube having a concave tip attached to a shaft that is 1-2 millimeters shorter than the concave tube. Each tube is thicker (e.g., has a larger outside and inside diameter) than each thin rod of the packing and crimping device. The closing and extruding device is adapted to close each pre-rolled cone and extrude each finished cigarette from within a corresponding tapered hole of the plate.

The plate may preferably be of a thickness adapted to facilitate crimping of a pre-rolled cone when marijuana is introduced into each pre-rolled cone sitting in a corresponding tapered hole defined in the plate, and each pre-rolled cone having been filled, packed, and crimped, with a smokable material therein, is extruded through the plate. In other words, after each pre-rolled cone is filled, packed, and crimped, with a smokable material therein, it is pushed down the tapered hole until it pops out of the location where the tapered hole communicates with the, typically lower, extrusion surface of the plate. The plate may preferably be at least 1.5625 inches thick, and preferably no more than 1.6875 inches thick. The base may preferably have a plurality of legs, such as two or four legs, but other numbers of legs may be used without departing from the scope of the invention as claimed.

The handle of the packing and crimping device, and the handle of the finishing and extruding device, may each preferably be made of high-density polyethylene (HDPE). Other materials, such as wood, may also be used. The plate may also preferably be comprised of HDPE.

In accordance with an aspect and embodiment of the disclosure, each of the at least one tubes of the closing and extruding device may be made of a hollow plastic tube with a concaved tip. Alternatively, each tube may be made of other materials, such as wood, metal, aluminum, or the like, suitable to the purpose of being sufficiently rigid to be used to push and compress (i.e., extrude) the filled pre-rolled cones out of the plate through its corresponding tapered hole. In this embodiment comprising tubes, each tube attaches to the handle by a shaft, such as a stainless-steel fastener inserted into each tube, and each tube is longer than each corresponding shaft. Each of the tubes may also be attached to the handle by other means suitable to the aforementioned purpose.

In accordance with an aspect and embodiment of the disclosure, each of the at least one thin rods of the packing and crimping device may preferably be made of a compressed stiff spring attached interposed and interconnecting between the handle and each thin rod. Each thin rod may be made of plastic and held by way of an integral collar (as part of the plastic rod) at the end of the compressed stiff spring. The aforementioned construction serves to allow some flexibility in action while working the packing and crimping device so as to align with the tapered holes in the plate and to allow a gentle circular motion to fold and crimp collapsed paper over an end of the cigarette as an initial, partial, closing. Accordingly, other materials suitable to this purpose and action may be used without departing from the scope of the invention as claimed.

In accordance with an aspect and embodiment of the disclosure, each of the at least one tapered holes defined in the plate is adapted to correspond to the taper of a pre-rolled cone, whether of a 98 mm size, or a 109 mm size, such that when the packing and crimping device gently packs each pre-rolled cone with filling material such as marijuana, each pre-rolled cone is packed but is preferably not yet pushed further into the pre-rolled cones' respective tapered holes. This pushing, or extruding, ideally doesn't happen until a later step than the filling and packing steps are completed so that additional material may be filled into the pre-rolled cone before an upper edge of the paper of the cone gets crimped—which crimp would prevent further material (such as marijuana) from getting into the cones. Once each pre-rolled cone is completely filled and packed, it is ready to be finished and extruded. Thus, it will thus be appreciated that the packing and crimping/finishing device is first used gently to pack each pre-rolled cone with material without first crimping the upper edge of each pre-rolled cone, since doing so may prevent further filling of the cones if necessary. After filling and gentle packing is completed, some initial crimping may be imparted by the packing and crimping device since the stickiness of the marijuana being packed into the pre-rolled cone with the packing and crimping device causes some crimping. And this is why packing must be done gently to prevent too early of crimping. After completion using the packing and crimping/finishing device, the closing and extruding device is then applied to each tapered hole having a filled and packed pre-rolled cone therein, the closing and extruding device thus being used to push each pre-rolled, filled, and packed cone further into its respective tapered hole. This latter process, known as extruding, causes each pre-rolled cone to begin to crimp further in earnest—or further crimp as some initial crimping has already begun with the filling and packing process (due to the stickiness of the marijuana pulling the paper inwardly with use of the packing and crimping/finishing device). And as each filled and packed pre-rolled cone is pushed further into its respective tapered hole using the closing and extruding device, the upper edge of each pre-rolled cone is folded further inwardly. In other words, as each pre-rolled cone is pushed further into its tapered hole with the closing and extruding device, they further close, they are extruded (compacted) until each pre-rolled cone is simultaneously pushed further and further into its respective tapered hole, and they are still further extruded until each finished cigarette is finally pushed out onto, or into, the catcher.

In accordance with an aspect and embodiment of the disclosure, the at least one tapered hole comprises a plurality of tapered holes arranged in a pattern, preferably of aligned columns and rows in the overall plate working surface shape of a square or a rectangle. In this embodiment, the at least one thin rod of the packing and crimping device comprises a plurality of thin rods arranged in a corresponding pattern, such as corresponding with either one or more rows of tapered holes in the plate. The plurality of thin rods are adapted to be brought into alignment with the plurality of tapered holes. Furthermore, the at least one tube of the closing and extruding device comprises a plurality of tubes arranged in a similarly corresponding pattern. The plurality of tubes are also adapted to be brought into alignment with the plurality of tapered holes in at least one row. In this aspect and embodiment of the disclosure, the at least one tube of the closing and extruding device also comprises a plurality of tubes oriented in a corresponding pattern. Thus, the plurality of tubes is adapted to be brought into alignment with the plurality of tapered holes in at least one row, but optionally in a corresponding pattern comprising more than one row.

In accordance with an aspect and embodiment of the disclosure, a pre-rolled cone filling, packing, finishing, and extruding apparatus, or cigarette manufacturing apparatus, is adapted for making and extruding cigarettes, such as marijuana cigarettes, onto a catcher (such as, for example, a table top or floor that is not part of the apparatus, or alternatively, a bucket onto which the plate and base are attached). The cigarette manufacturing apparatus has a plate having a working surface, a rim portion, and an extrusion surface (opposite the working surface). The plate defines at least one tapered hole communicating with the working surface. Each tapered hole is wider where it communicates with the working surface of the plate, and each tapered hole tapers to be narrower where it communicates with the (preferably lower) extrusion surface. The plate is adapted to receive and hold a pre-rolled cone into each tapered hole, wherein preferably each tapered hole is also tapered to correspond with (i.e., adapted to receive and hold) a given size, such as a 98 mm size, or a 109 mm size, of pre-rolled cone. A base is attached to the plate and adapted for holding the plate sufficiently spaced from the catcher. The sufficient space allows each pre-rolled cone, which is adapted to be held and received by each corresponding tapered hole, to be suspended relative to the catcher to allow for extruding of a finished cigarette onto the catcher. The cigarette manufacturing apparatus further comprises a combination packing, crimping, closing, and extruding device having a handle with at least one thin rod extending from a spring from, and preferably within, the handle. Each rod is adapted to fill and crimp a pre-rolled cone retained within a corresponding tapered hole. The handle in accordance with this aspect and embodiment also has a tube corresponding to each thin rod. Each tube also extends from the handle, and each tube preferably has an outside diameter that is larger than each corresponding thin rod. Each thin rod is preferably adapted to reside partially within a corresponding tube. Each tube closes and extrudes a finished cigarette from within each corresponding tapered hole.

The base may preferably comprise a plurality of legs. The number of legs may be two, but other numbers of legs may be used. The handle of the combination packing, crimping, closing, and extruding device may preferably be made of high-density polyethylene (HDPE). However, the handle may be made of other materials known in the art, such as wood. The plate may also preferably be of HDPE.

Preferably, the plate thickness may preferably be at least 1.5625 inches thick and no more than 1.6875 inches thick, at least as pertaining to pre-rolled cones of the 98 mm size and the 109 mm size. Each tapered hole may preferably be adapted to correspond to the taper of a pre-rolled cone such that when the combination packing, crimping, closing, and extruding device packs each pre-rolled cone with filling material, such as marijuana, each pre-rolled cone is pushed further into the plate. This pushing of pre-rolled cone crimps the upper edge of each pre-rolled cone inwardly. When the combination packing, crimping, closing, and extruding device closes each pre-rolled cone, each pre-rolled cone is simultaneously pushed further into its corresponding tapered hole. Thus, the cigarette manufacturing apparatus as a whole is adapted for transforming the pre-rolled cone and filling material into a cigarette, until each finished cigarette extrudes onto, or into, the catcher.

In accordance with this aspect and embodiment of the disclosure, the at least one tapered hole may preferably be a plurality of tapered holes. In such embodiment, the at least one thin rod of the combination filling, crimping, closing, and extruding device preferably comprises a plurality of thin rods that are adapted to align with the plurality of tapered holes, and the at least one tube of the combination packing, crimping, closing, and extruding device preferably comprises a plurality of tubes that are adapted to align with the plurality of tapered holes.

In accordance with an aspect and embodiment of the disclosure, the at least one tapered hole comprises a plurality of tapered holes oriented in a pattern of rows. In such embodiment, the at least one thin rod of the combination packing, crimping, closing, and extruding device comprises a plurality of thin rods that align with a plurality of tapered holes in at least one row, and the at least one tube of the combination packing, crimping, closing, and extruding device comprises a plurality of tubes that align with a plurality of tapered holes in at least one row.

In accordance with an aspect and embodiment of the disclosure, a pre-rolled cone finishing and extruding method for filling, packing, finishing, and extruding cigarettes, such as marijuana cigarettes, onto, or into, a catcher, is comprised of:

Step A: obtaining a pre-rolled cone filling, packing, finishing, and extruding apparatus with a plate comprising a working surface and a rim portion, and the plate defining a plurality of tapered holes communicating with the working surface, wherein the plurality of tapered holes are wider where each tapered hole communicates with the working surface of the plate, the plate adapted to receive and hold a plurality of pre-rolled cones into the plurality of tapered holes, a base attached to the plate, wherein the base is sufficiently spaced from the catcher to allow the plurality of pre-rolled cones received by the plurality of tapered holes to be suspended at least sufficiently spaced from the catcher to allow for extruding of the plurality of finished cigarettes onto, or into, the catcher, a packing and crimping device having a handle attached to at least one thin rod adapted to fill, pack and crimp a corresponding plurality of pre-rolled cones within the plurality of tapered holes, and a closing and extruding device having a handle attached to at least one tube that is thicker (e.g., has a larger diameter) than the at least one thin rod, and is adapted to close the plurality of pre-rolled cones and extrude finished cigarettes from within the plurality of tapered holes;

Step B: placing a plurality of pre-rolled cones into the plurality of tapered holes in the plate;

Step C: pouring the filling material, such as marijuana, for the plurality of pre-rolled cones onto the working surface of the plate such that the filling material is contained within the working surface by the rim portion of the plate;

Step D: shaking and tilting the plate to guide the filling material into the plurality of pre-rolled cones held in the plurality of tapered holes;

Step E: repeating steps B through D until the plurality of pre-rolled cones are filled;

Step F: inserting each thin rod of the packing and crimping device into the plurality of tapered holes with the plurality of pre-rolled cones and moving each thin rod of the packing and crimping device in a gentle up and down circular pattern repeatedly within the plurality of tapered holes (but in the center of each hole at first away from the pre-rolled paper cone edges) to pack the marijuana into the plurality of pre-rolled cones;

Step G: continuing the up and down circular pattern closer to the pre-rolled paper cone edges causing the upper edge of each pre-rolled cone to crimp inwardly as the pressure from each thin rod begins, with more pressure applied to push each pre-rolled cone slightly further into each corresponding tapered hole to bring the upper edge of each pre-rolled cone inwardly and such that the stickiness of the marijuana also pulls the upper edge of each pre-rolled cone inwardly;

Step H: inserting each tube of the closing and extruding device into corresponding tapered holes, and pushing the crimped end of each pre-rolled cone to fold to close off the pre-rolled cone; and Step I: exerting further pressure onto the closing and extruding device having tubes located in corresponding tapered holes, to extrude the plurality of finished cigarettes out of the plurality of tapered holes and onto, or into, the catcher.

In accordance with another aspect and embodiment of the disclosure, a pre-rolled cone finishing and extruding method for filling, packing, finishing, and extruding cigarettes, such as marijuana cigarettes, onto a catcher, is comprised of the following steps:

Step A: obtaining a pre-rolled cone filling, packing, finishing, and extruding apparatus with a plate comprising a working surface and a rim portion, and the plate defining a plurality of tapered holes communicating with the working surface, wherein the plurality of tapered holes are wider where each tapered hole communicates with the working surface of the plate, the plate adapted to receive and hold a plurality of pre-rolled cones into the plurality of tapered holes, a base attached to the plate wherein the base is sufficiently spaced from the catcher to allow the plurality of pre-rolled cones received by the plurality of tapered holes to be suspended at least sufficiently spaced from the catcher to allow for extruding of the plurality of finished cigarettes, and a combination packing, crimping, closing, and extruding device having a handle attached by means of at least one spring to a corresponding at least one thin rod adapted to fill and crimp a corresponding plurality of pre-rolled cones within the plurality of tapered holes, the handle also being attached to at least one hollow tube within which each corresponding thin rod partially resides, each hollow tube's inner and outer diameters being wider than each corresponding thin rod and adapted to close and extrude the finished cigarettes from within the plurality of tapered holes;

Step B: placing a plurality of pre-rolled cones into the plurality of tapered holes in the plate;

Step C: pouring the filling material, such as marijuana, for the plurality of pre-rolled cones onto the working surface of the plate such that the filling material is contained within the working surface by the rim portion of the plate;

Step D: shaking and tilting the plate to guide the filling material into the plurality of pre-rolled cones in the plurality of tapered holes;

Step E: repeating steps B through D until the plurality of pre-rolled cones are filled;

Step F: inserting each thin rod of the combination packing, crimping, closing, and extruding device into the plurality of tapered holes with the plurality of pre-rolled cones and moving the at least one thin rod of the combination packing, crimping, closing, and extruding device around in a gentle up and down circular pattern repeatedly within the plurality of tapered holes (but in the center of each hole at first away from the pre-rolled paper cone edges) to pack the marijuana into the plurality of pre-rolled cones;

Step G: continuing the up and down circular pattern closer to the pre-rolled paper cone edges causing the upper edge of each of the plurality of pre-rolled cones to crimp inward as the pressure from the at least one thin rod begins, with more pressure applied to push each of the plurality of pre-rolled cones slightly further into each of the corresponding plurality of tapered holes to bring the upper edge of each the plurality of pre-rolled cones inwardly and such that the stickiness of the marijuana also pulls the upper edges of the plurality of pre-rolled cones inwardly;

Step H: pushing down further so as to cause the at least one tube of the combination packing, crimping, closing, and extruding device and pushing the crimped end of each of the plurality of pre-rolled cones to fold to close off the plurality of pre-rolled cones; and Step I: exerting further pressure onto the combination packing, crimping, closing, and extruding device to extrude the plurality of finished cigarettes out of the plurality of tapered holes and onto, or into, the catcher.

The subject matter of the present invention is particularly pointed out and distinctly claimed in the concluding portion of this specification. However, both the organization and method of operation, together with further advantages and objects thereof, may best be understood by reference to the following descriptions taken in connection with accompanying drawings.

BRIEF DESCRIPTIONS OF DRAWINGS

FIG. 1A is a perspective view of a portion of an embodiment of a pre-rolled cone filling, packing, finishing, and extruding apparatus (hereafter also referred to as a "cigarette manufacturing apparatus" or "the apparatus") in accordance with one or more aspects of the disclosure, with a plurality of tapered holes oriented in a pattern of 10 rows and 10 columns and a base comprised of two legs, the apparatus shown being loaded with filling material, such as marijuana.

Figure 1A:
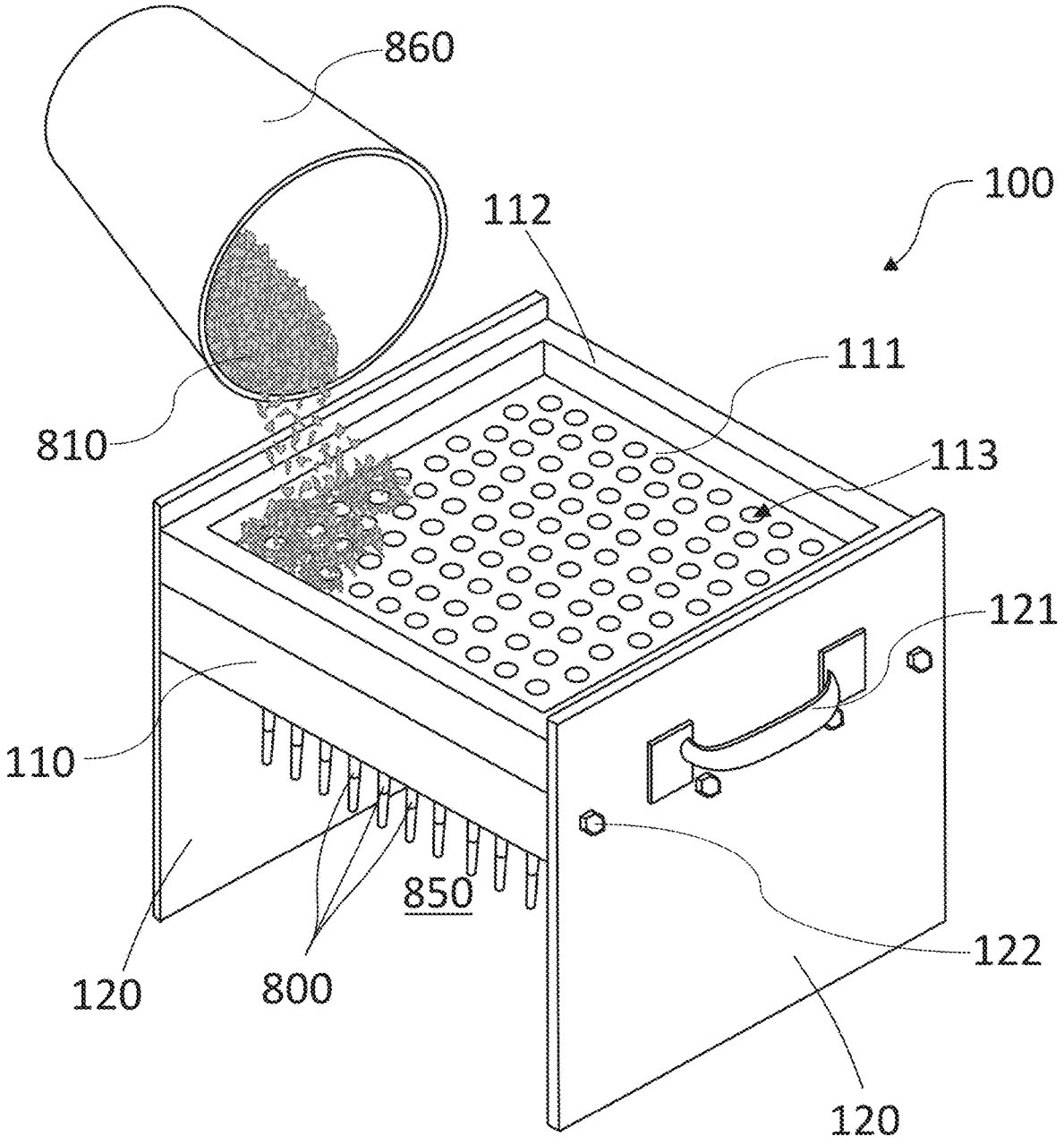
FIG. 1B is a perspective view of the portion of the embodiment shown in FIG. 1A and further showing broken out a portion of the plate of the apparatus of FIG. 1A, wherein the plate and dotted lines show how the tapered holes may hold a plurality of pre-rolled cones.
FIG. 1C is a top view of the portion of the embodiment shown in FIG. 1A and further showing some of the rightmost tapered holes empty, some of the next rightmost tapered holes holding pre-rolled cones, and some of the leftmost tapered holes holding pre-rolled cones filled with filling material.
Figure 1B:
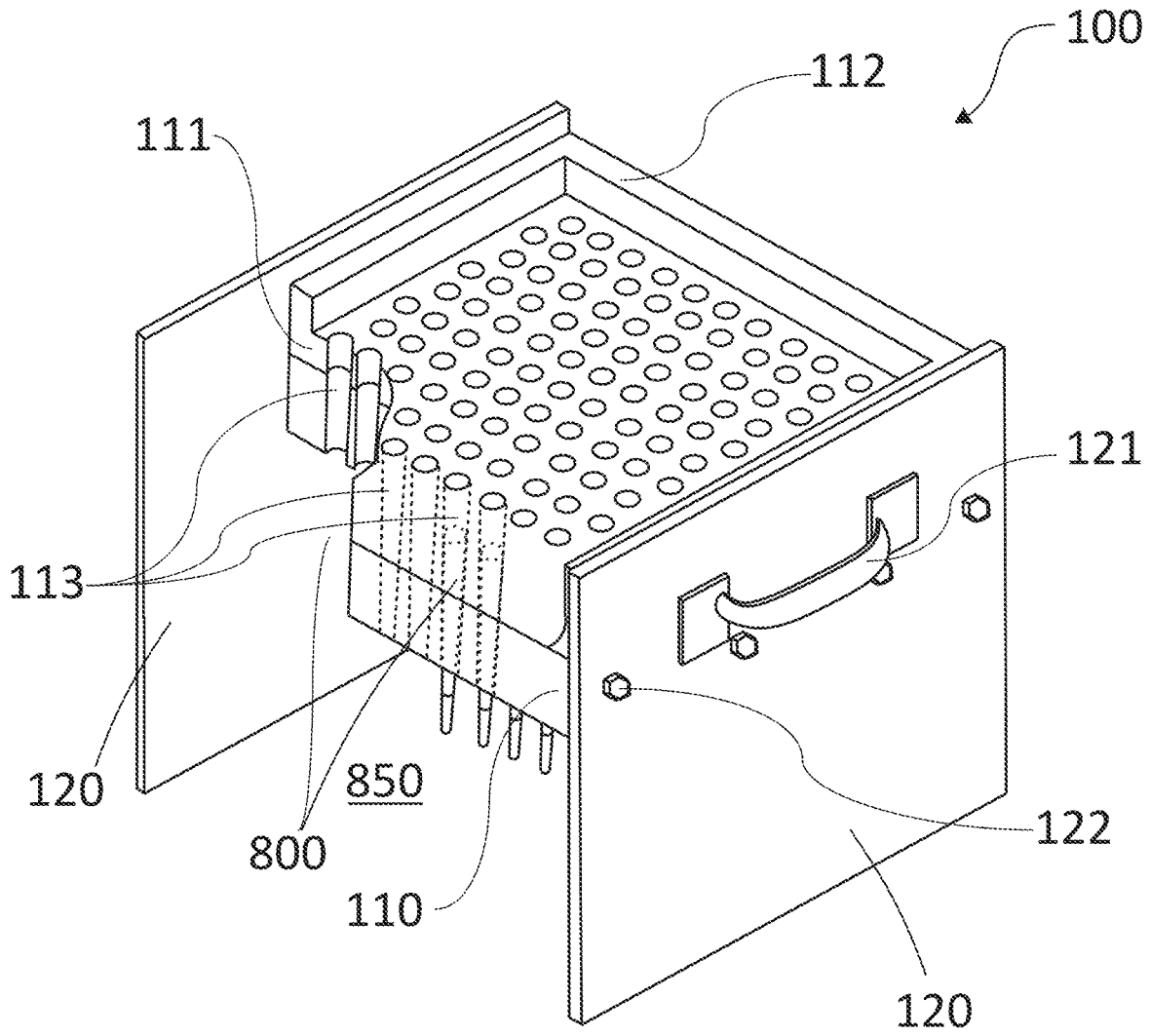
Figure 1C:
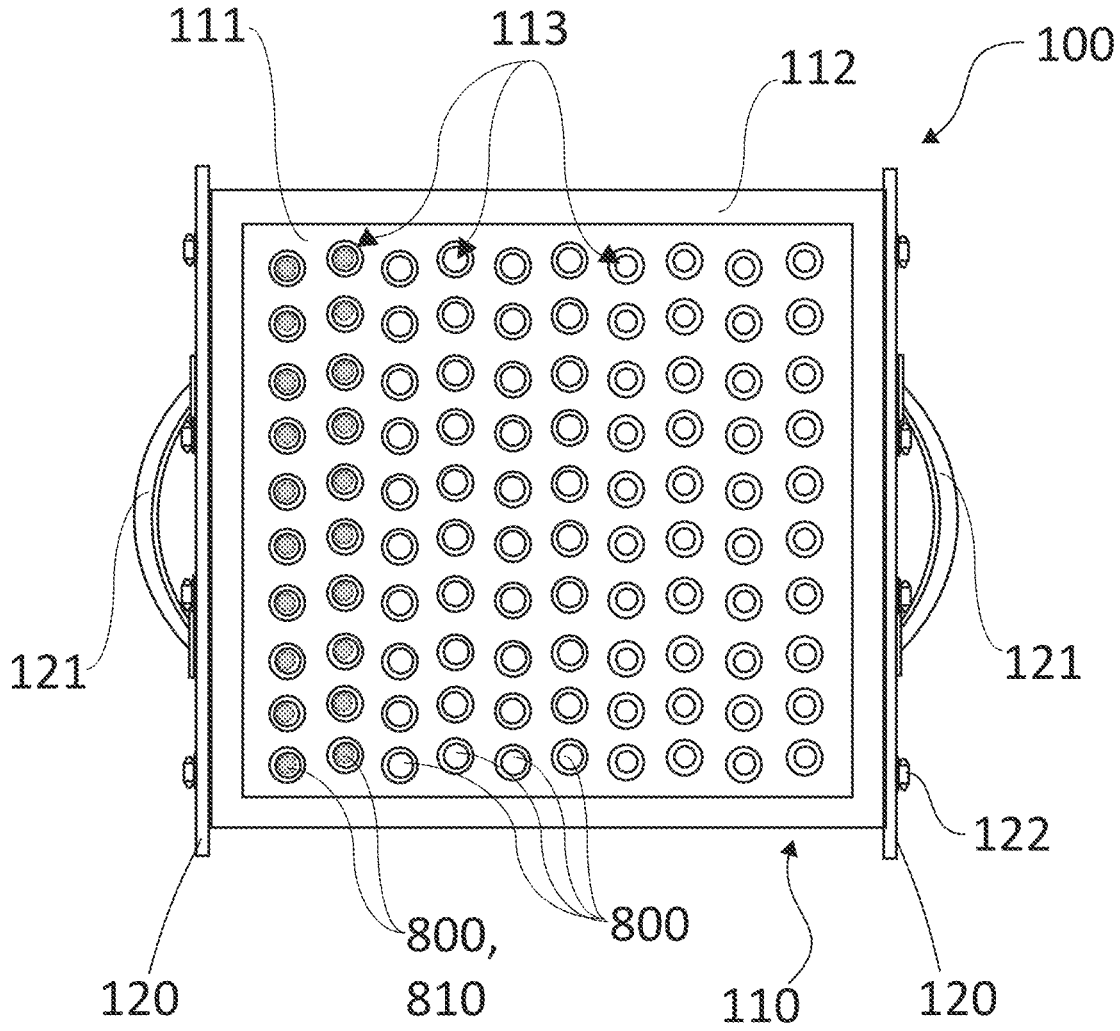
Figure 2A:
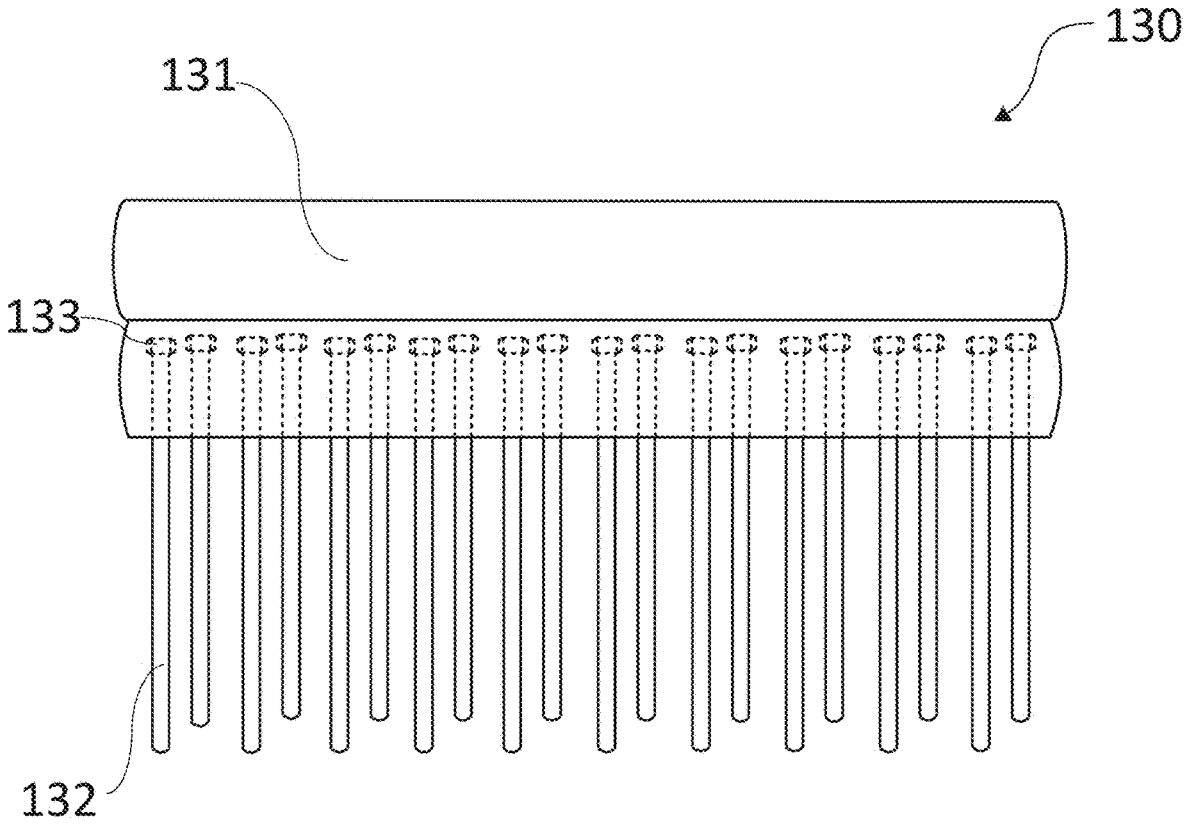
FIG. 2A is a side view of an embodiment of a packing and crimping device portion of a filling, packing, finishing, and extruding apparatus in accordance with one or more aspects of the disclosure, the device having a plurality of thin rods oriented in a pattern of two offset rows and adapted for use with the apparatus of FIGS. 1A-1C.
Figure 2B:
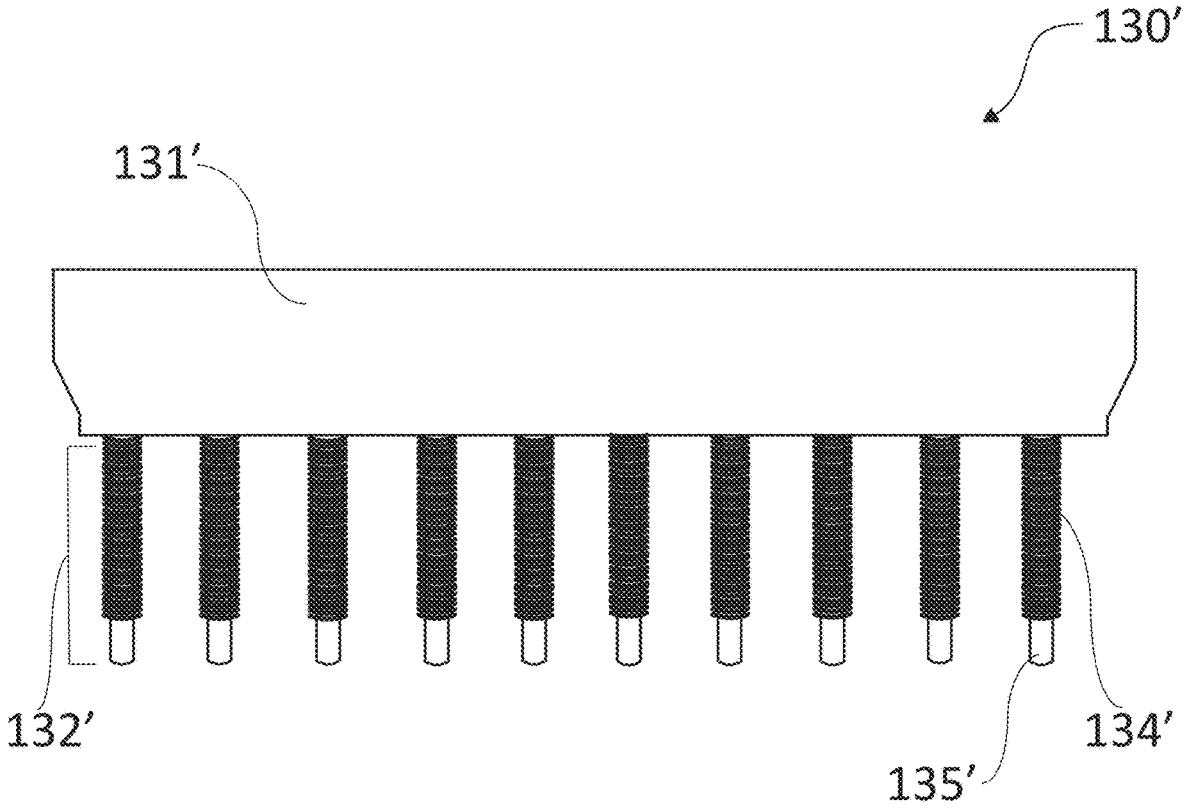

FIG. 2B is a side view of another embodiment of a packing and crimping device portion of a filling, packing, finishing, and extruding apparatus in accordance with one or more aspects of the disclosure, the device having a plurality of thin rods oriented in a pattern of a row that are each comprised of a spring and a plastic tip adapted for use with the portion of the filling, packing, finishing, and extruding apparatus of FIGS. 1A-1C.

Figure 3:
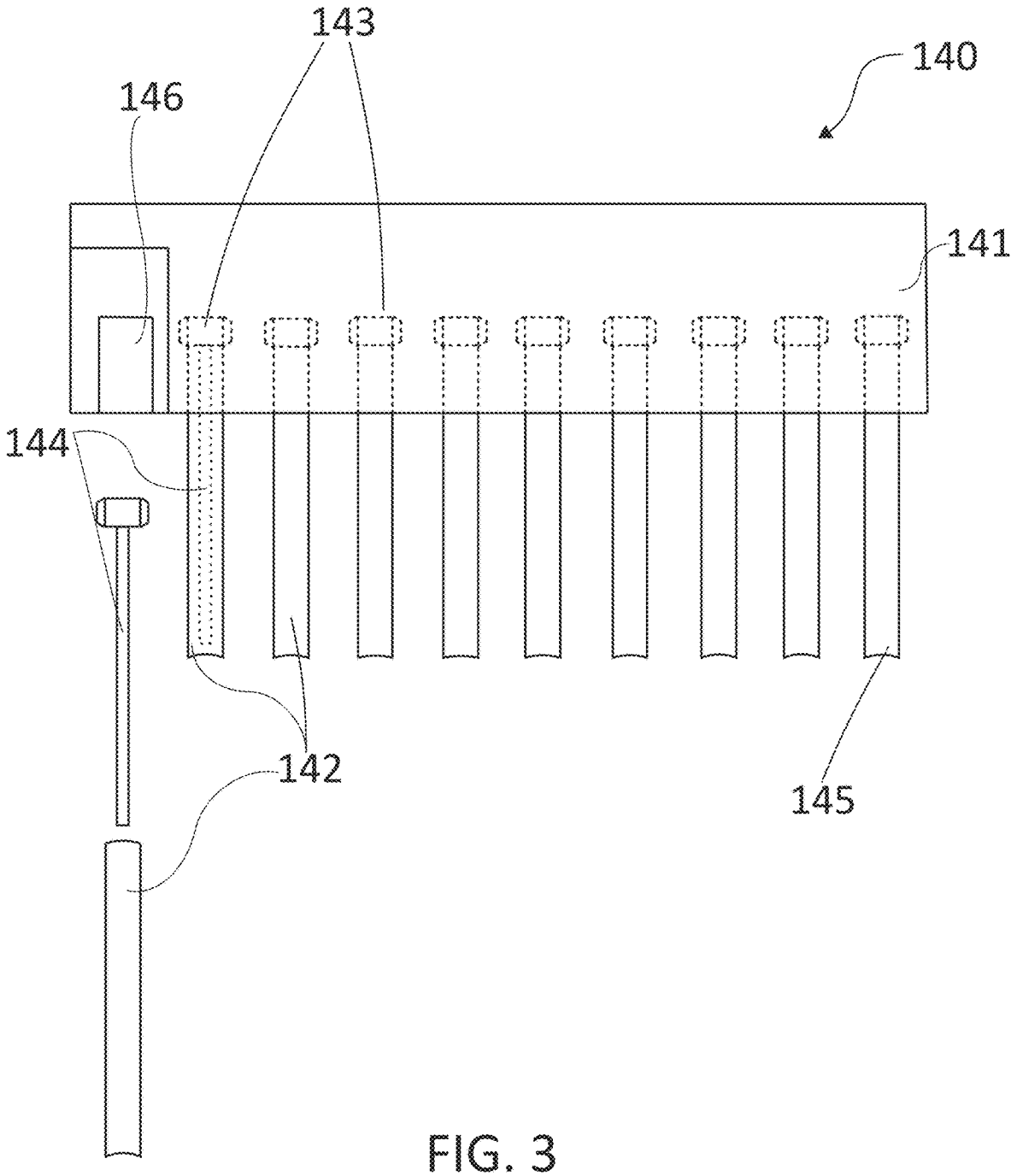

FIG. 3 is a partially-exploded side view of another embodiment of a closing and extruding device portion of a filling, packing, finishing, and extruding apparatus in accordance with one or more aspects of the disclosure, the device having a plurality of tubes, with a portion of the handle shown broken out, as well as with dotted lines, to show how the plurality of tubes attach to the handle.

Figure 4:
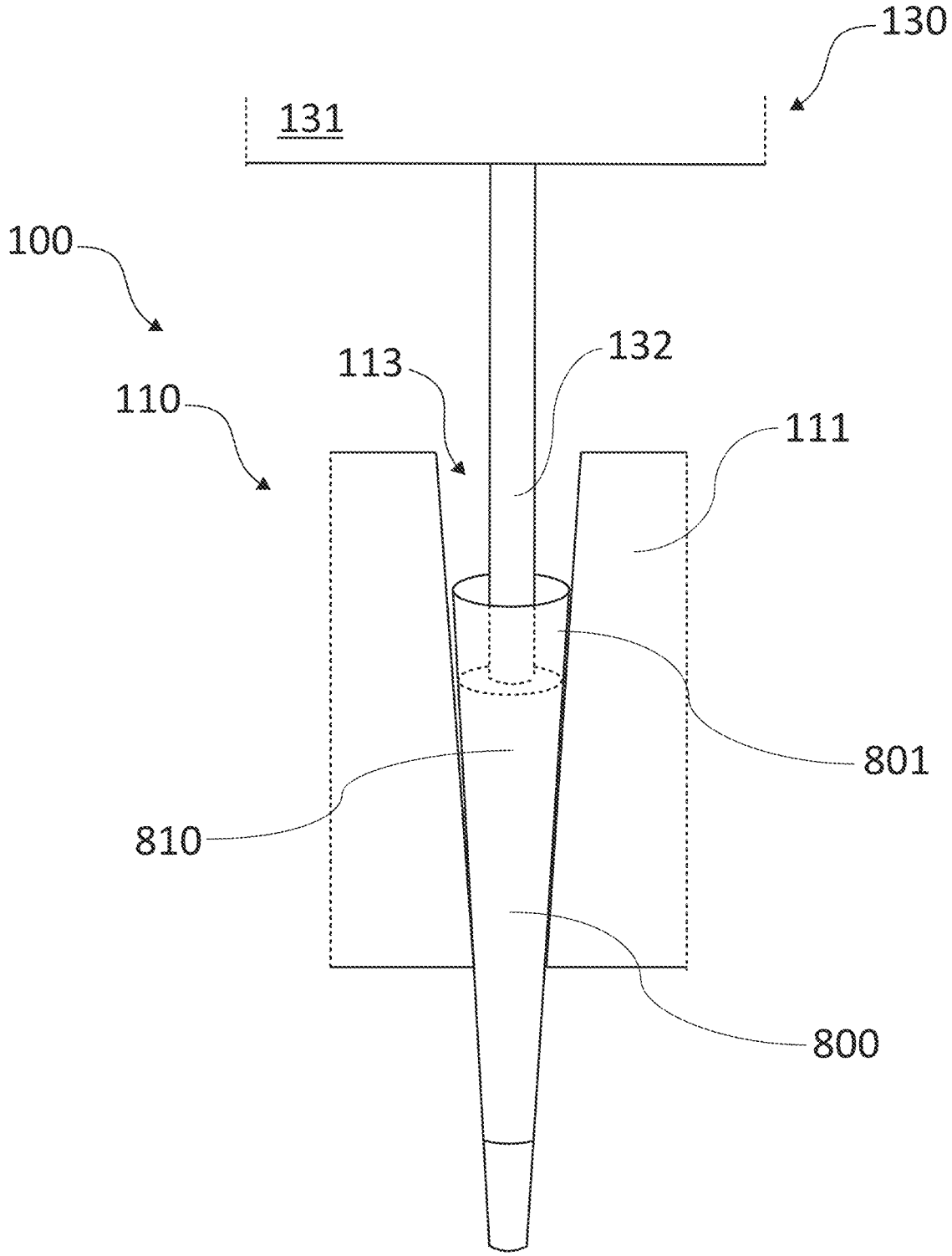

FIG. 4 is a close-up longitudinal cross-section side view of a tapered hole of a portion of an embodiment of a pre-rolled cone filling, packing, finishing, and extruding apparatus in accordance with one or more aspects of the disclosure, showing the tapered hole holding a pre-rolled cone filled with material within the plate, and further showing a thin rod of a packing and crimping device inserted into the pre-rolled cone.

Figure 5:
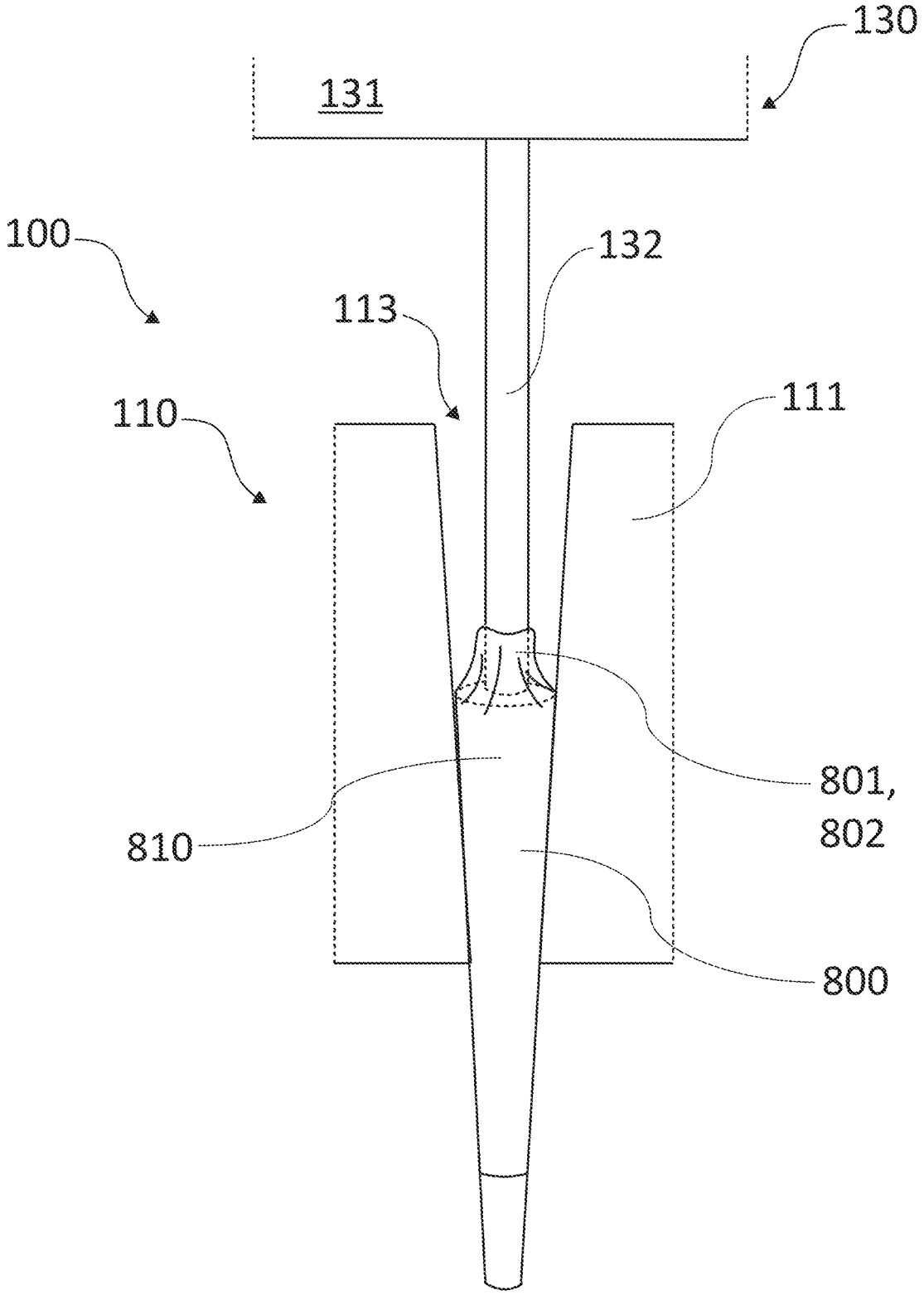

FIG. 5 is a close-up longitudinal cross-section side view of a tapered hole of a portion of an embodiment of a pre-rolled cone filling, packing, finishing, and extruding apparatus in accordance with one or more aspects of the disclosure, showing the tapered hole holding a pre-rolled cone filled with material within the plate, and further showing a thin rod of a packing and crimping device in the process of crimping the upper edge of the pre-rolled cone.

Figure 6:
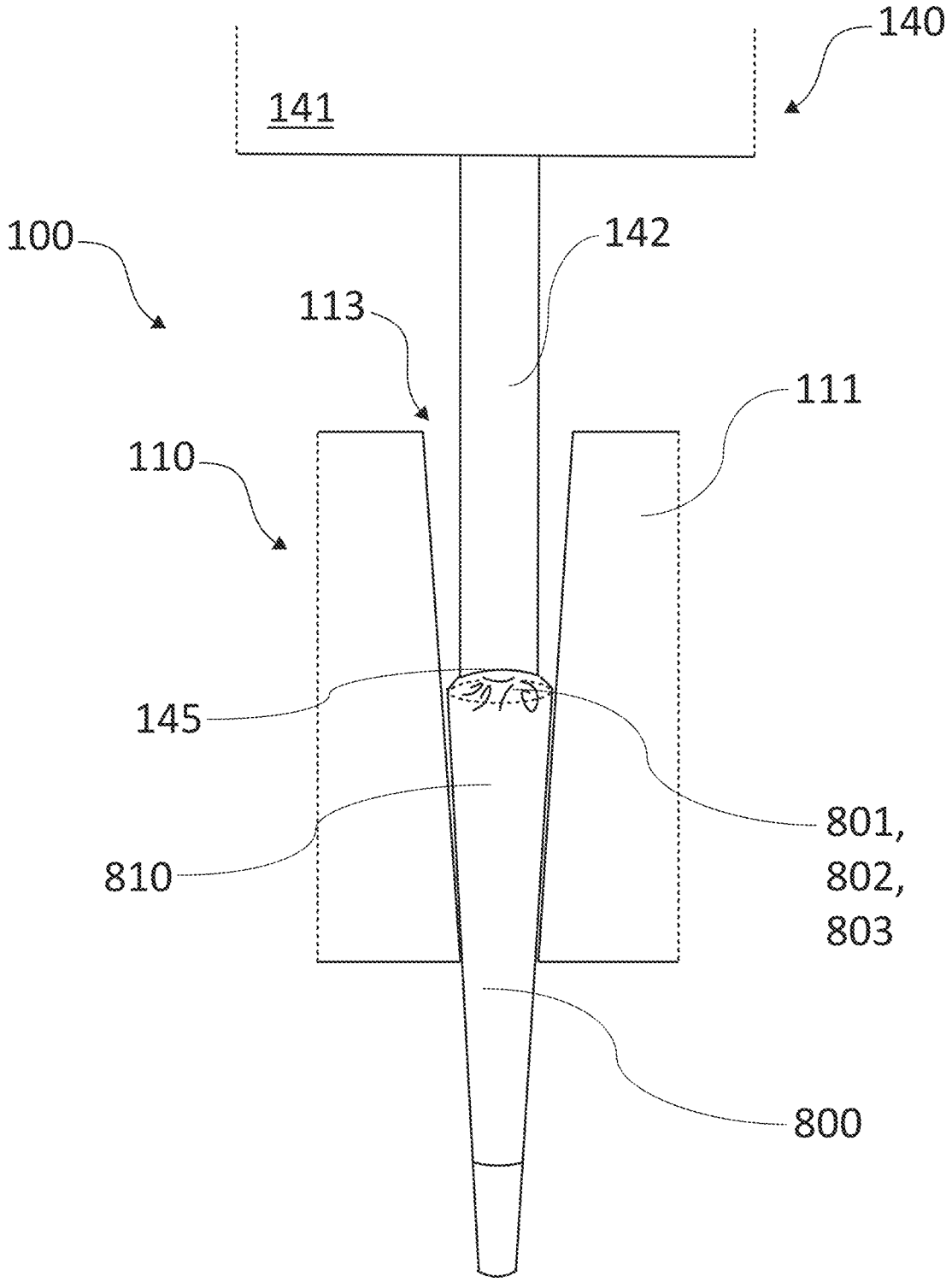

FIG. 6 is a close-up longitudinal cross-section side view of a tapered hole of a portion of an embodiment of a pre-rolled cone filling, packing, finishing, and extruding apparatus in accordance with one or more aspects of the disclosure, showing the tapered hole holding a pre-rolled cone filled with material within the plate, and further showing a tube of a closing and extruding device pushing against the crimped upper edge to close the pre-rolled cone.

Figure 7:
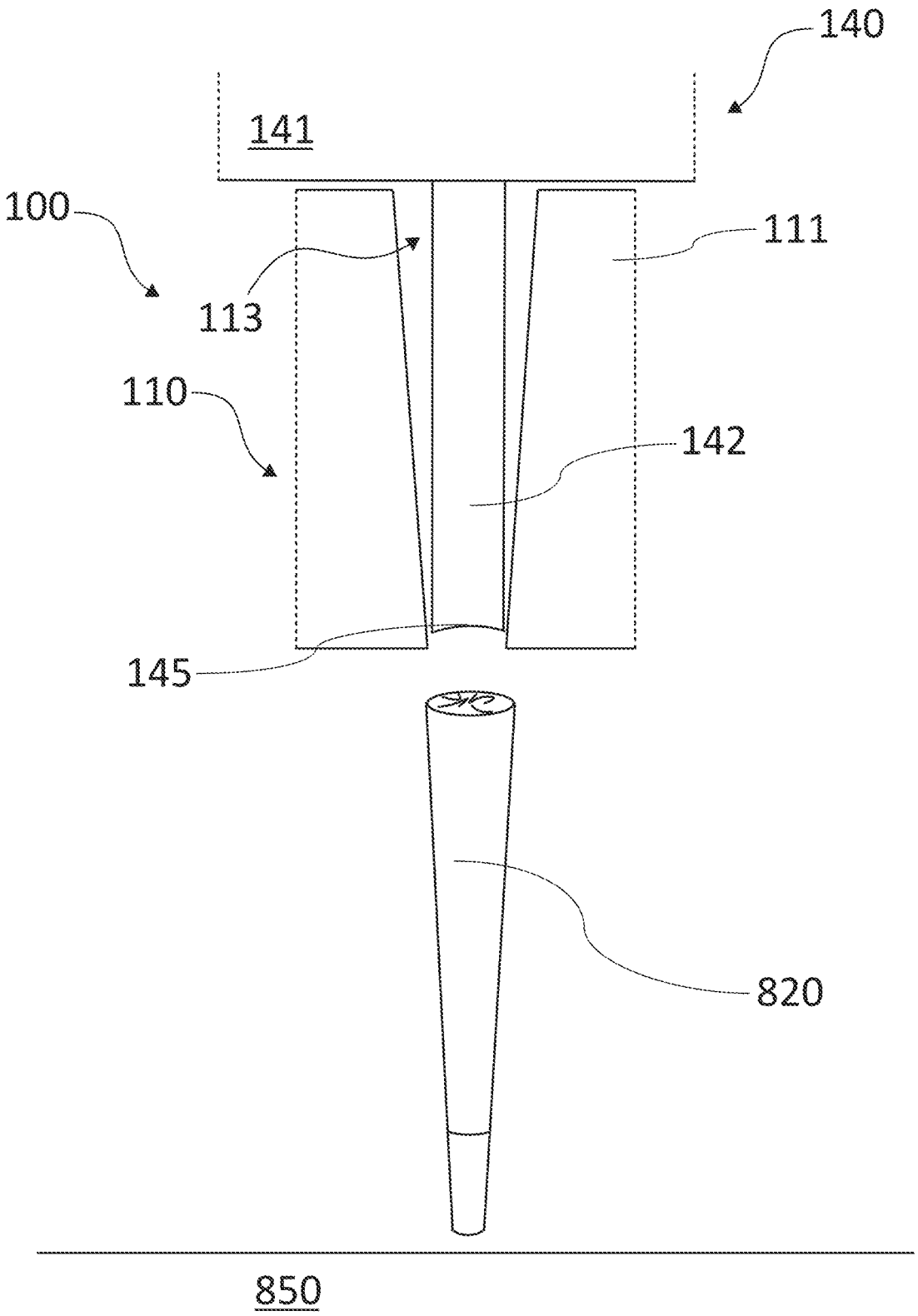

FIG. 7 is a close-up longitudinal cross-section side view of a tapered hole of a portion of an embodiment of a pre-rolled cone filling, packing, finishing, and extruding apparatus in accordance with one or more aspects of the disclosure, showing the tapered hole, and further showing a tube of a closing and extruding device pushing and extruding a finished cigarette from the tapered hole.

Figure 8:
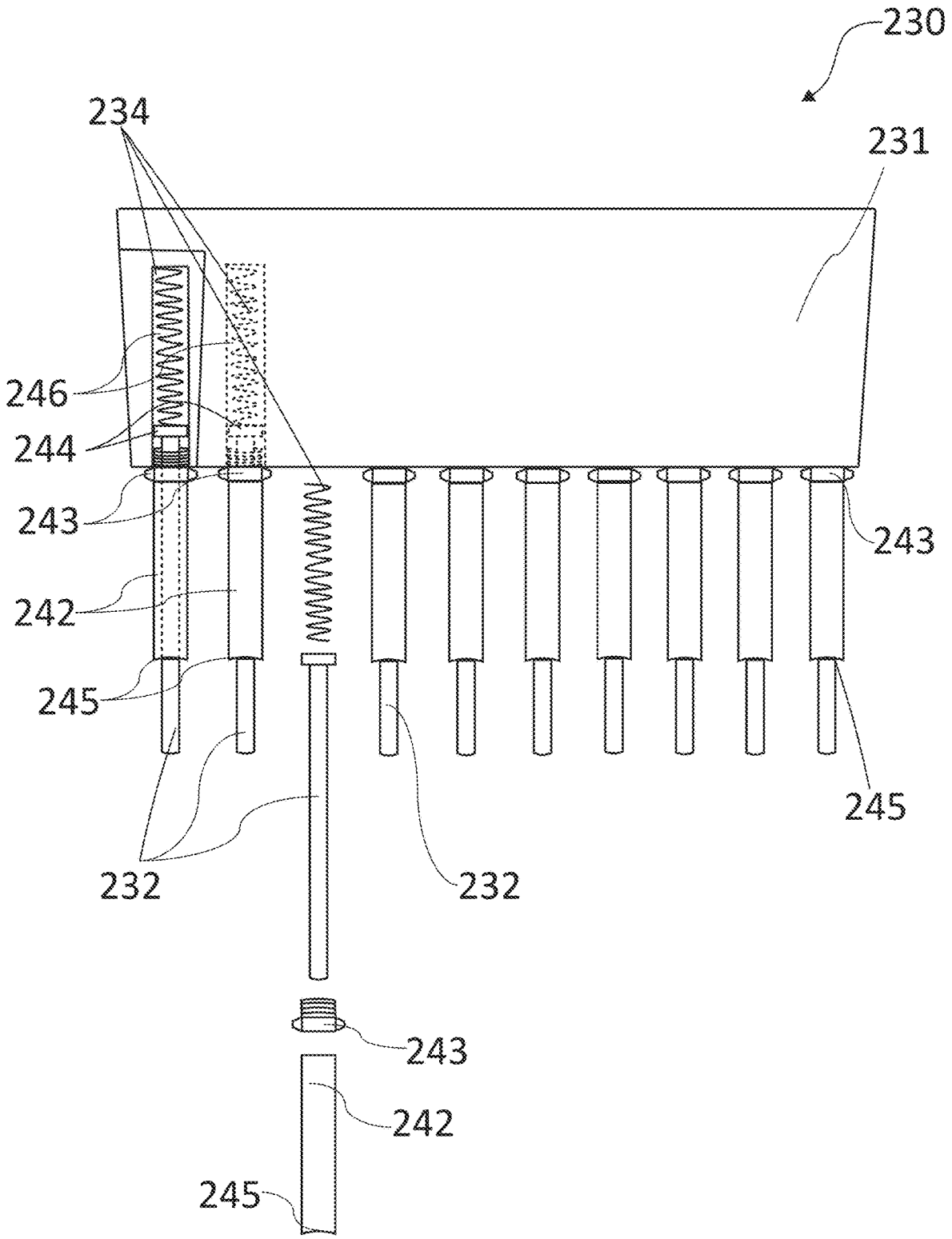

FIG. 8 is a side view of a combination packing, crimping, closing, and extruding device portion of a filling, packing, finishing, and extruding apparatus and having a plurality of thin rods and tubes oriented in a row in accordance with one or more aspects of the disclosure, the device being shown partially broken out to show the internal structure and workings of the device at a portion of the handle, as well as with dotted lines to show how the handle attaches the tubes, the thin rods, and the springs.

Figure 9:
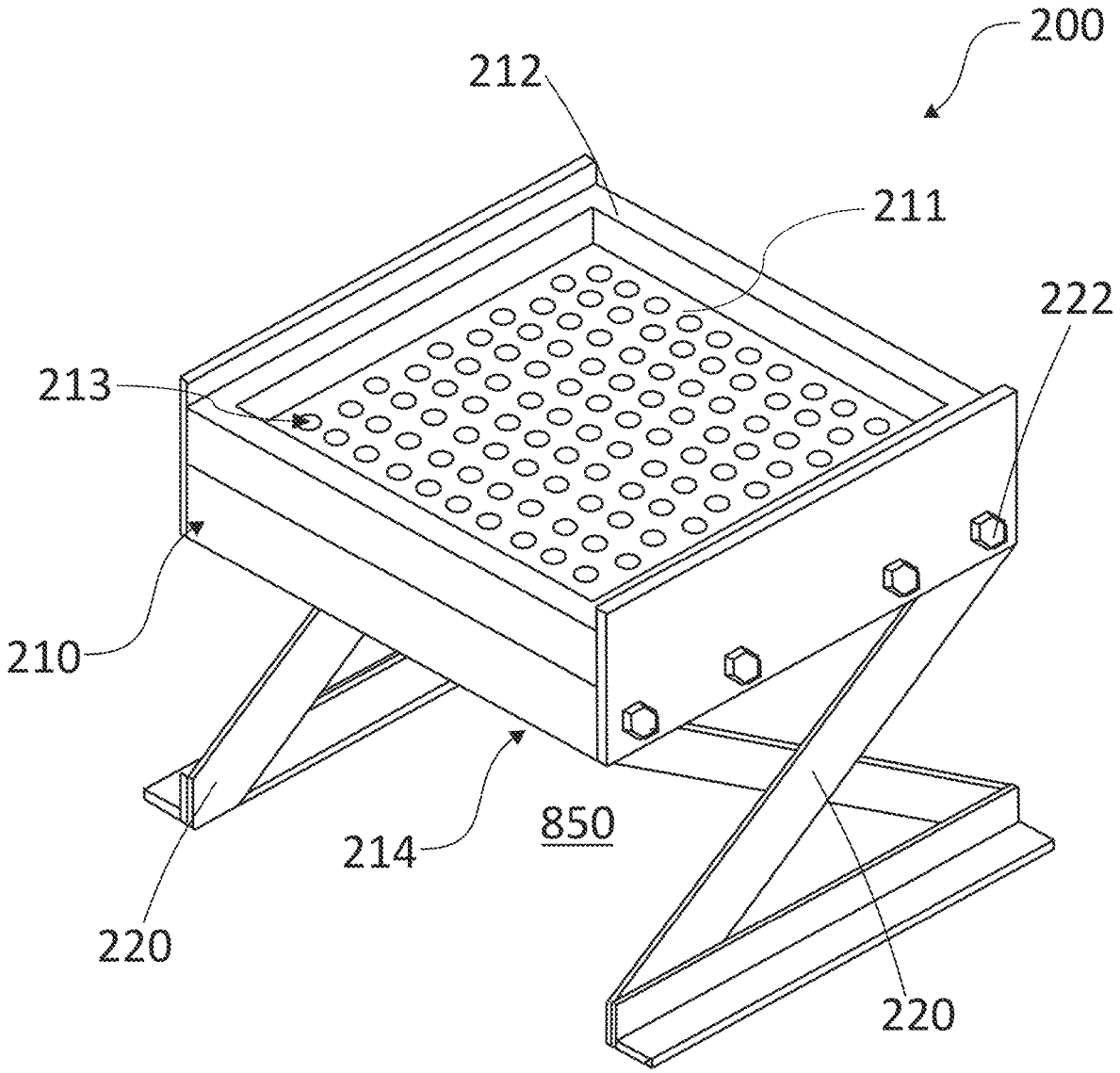

FIG. 9 is a perspective view of an embodiment of a portion of a pre-rolled cone filling, packing, finishing, and extruding apparatus in accordance with one or more aspects of the disclosure, with a plurality of tapered holes oriented in a pattern of 10 rows and a base comprised of two legs that differ from the base of FIGS. 1A-1C.

Figure 10:
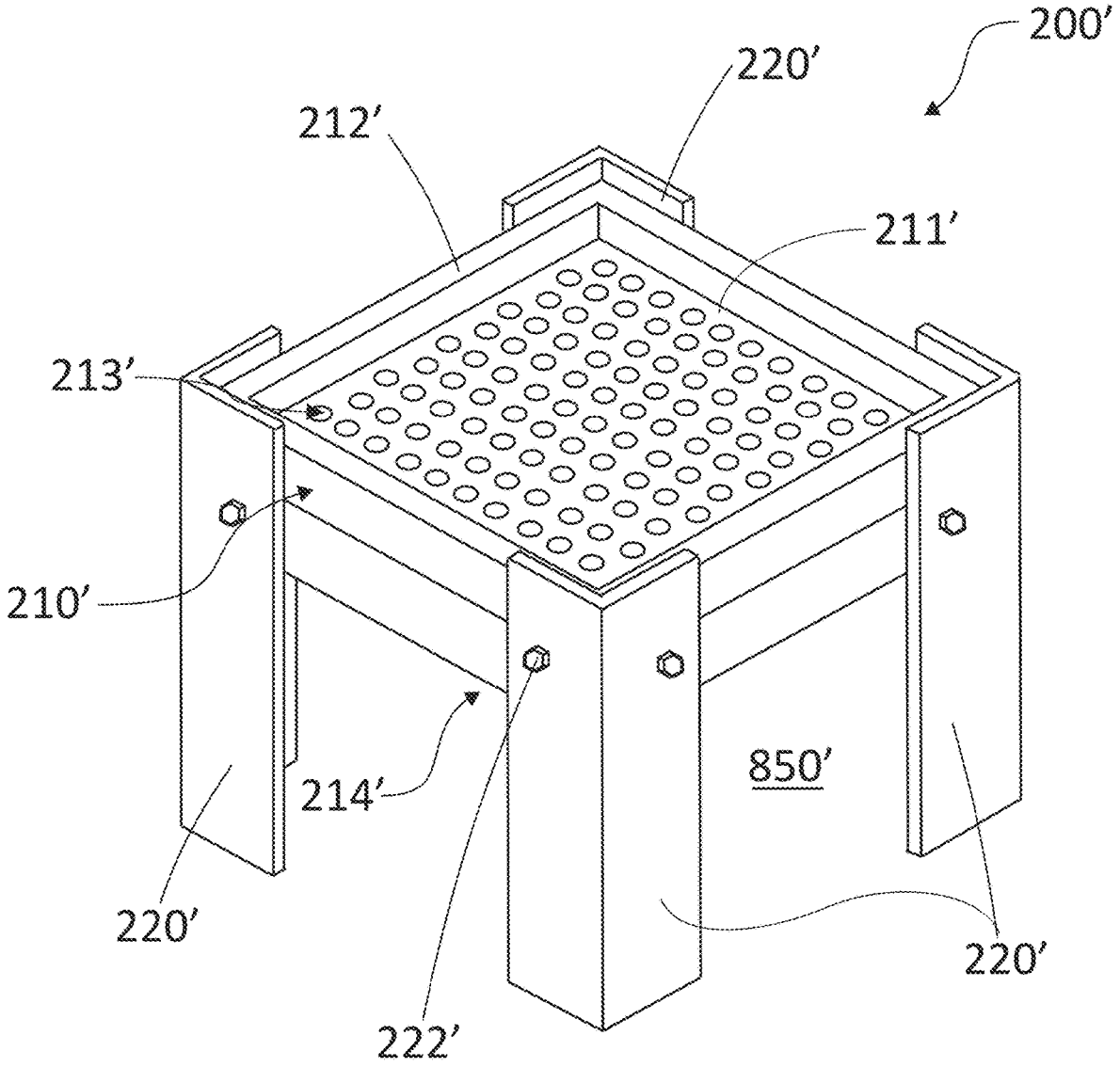

FIG. 10 is a perspective view of another embodiment of a portion of a pre-rolled cone filling, packing, finishing, and extruding apparatus in accordance with one or more aspects of the disclosure, with a plurality of tapered holes oriented in a pattern of 10 rows and a base comprised of four legs.

Figure 11:
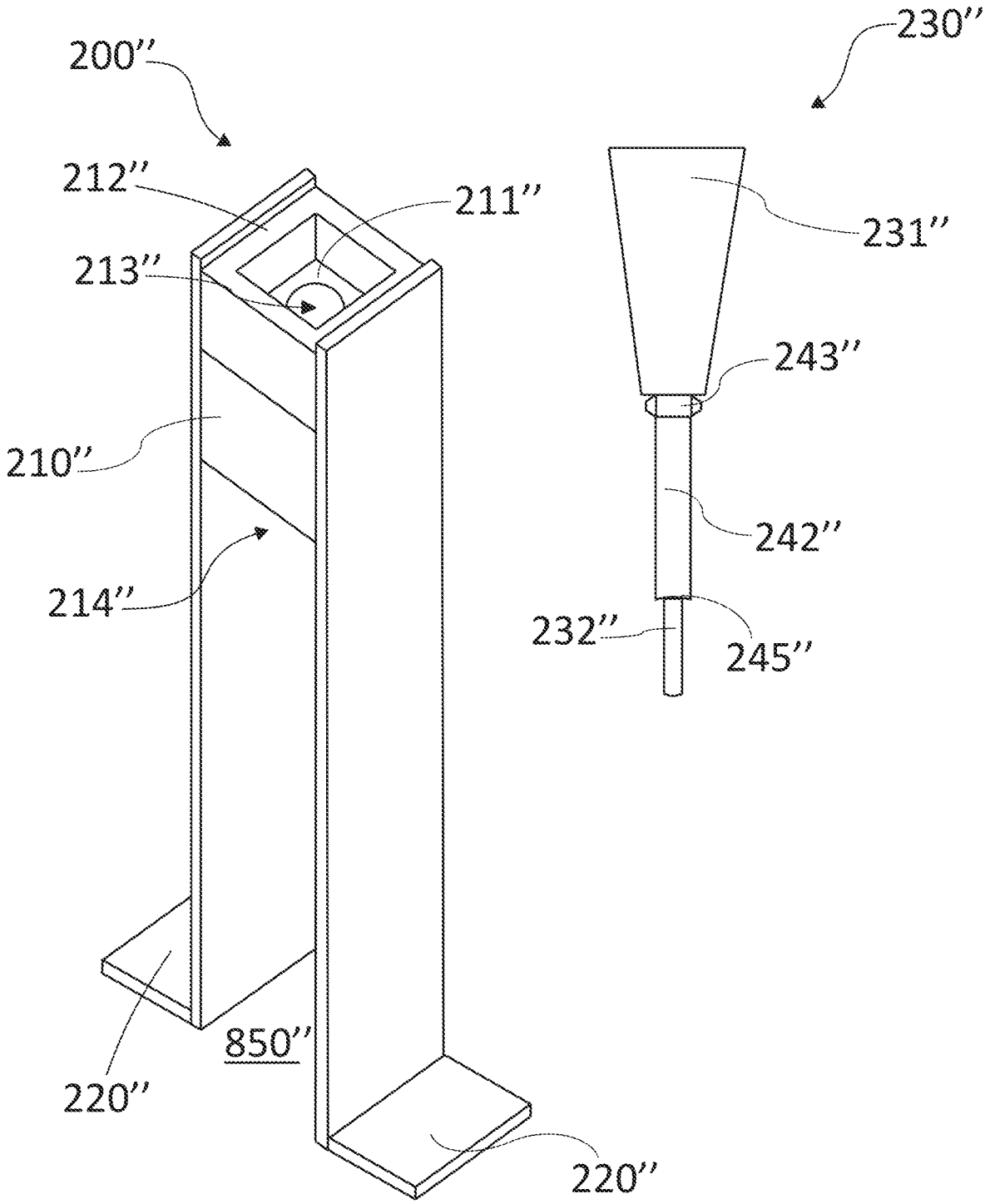
Figure 12:
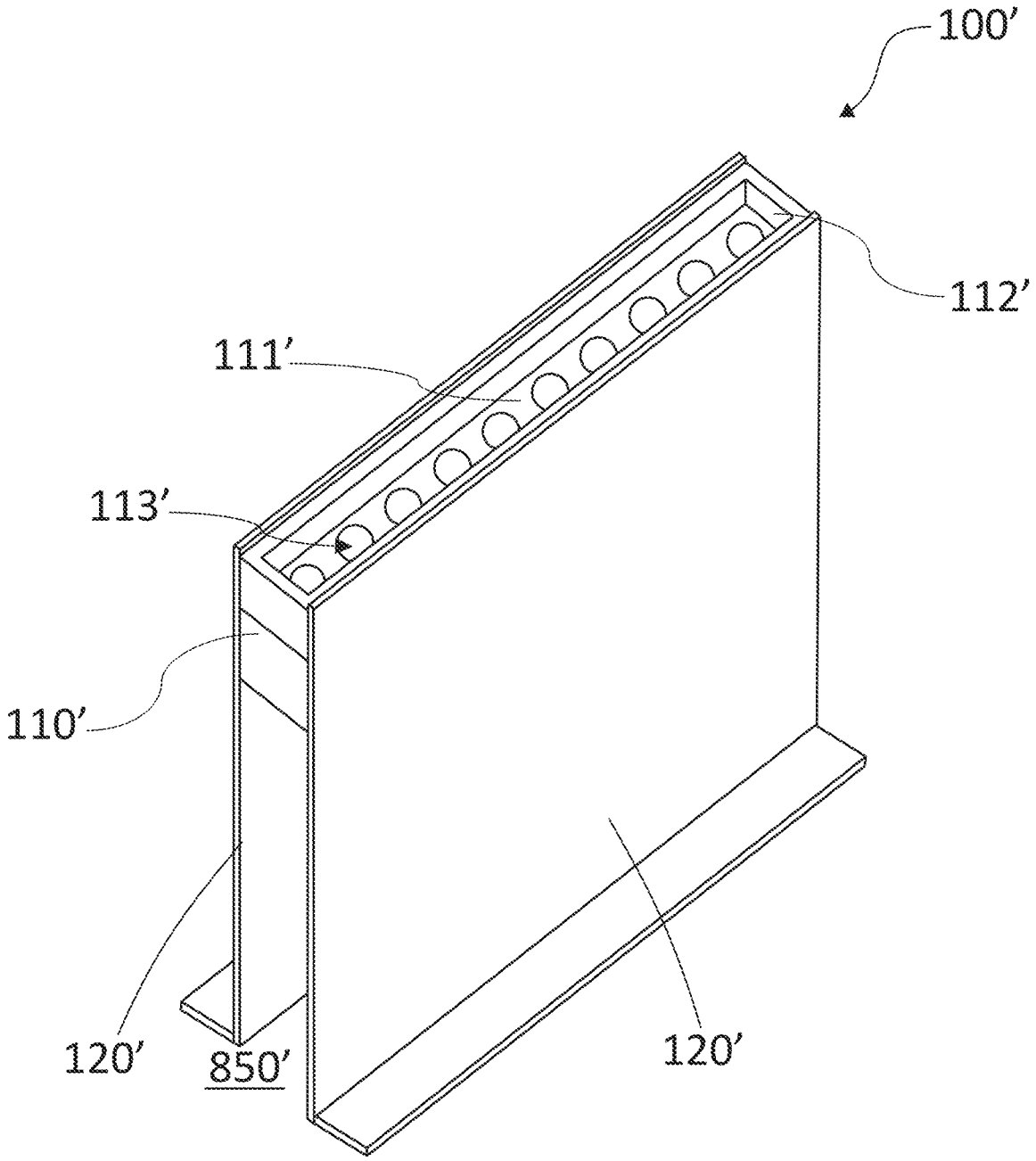

FIG. 11 is a perspective view of another embodiment of a pre-rolled cone filling, packing, finishing, and extruding apparatus in accordance with one or more aspects of the disclosure, with a single tapered hole and a base comprised of two legs, and an combination packing, crimping, closing, and extruding device comprised of one thin rod and one tube FIG. 12 is a perspective view of another embodiment of a portion of a pre-rolled cone filling, packing, finishing, and extruding apparatus in accordance with one or more aspects of the disclosure, with a plurality of tapered holes oriented in a pattern of a row and a base comprised of two legs.

DETAILED DESCRIPTION

The present disclosure provides various embodiments of a pre-rolled cone filling, packing, finishing, and extruding apparatus (hereafter referred to also as a "cigarette manufacturing apparatus" or "the apparatus"), use applications thereof, and related methods of filling, packing, finishing, and extruding cigarettes, such as marijuana cigarettes, onto a catcher.

Referring generally to FIGS. 1A-1C, there is shown a perspective view of an embodiment of a portion 100 of a pre-rolled cone filling, packing, crimping, finishing, and extruding apparatus in accordance with one or more aspects of the disclosure. The apparatus portion 100 comprises a plate 110, having a working surface in and a rim portion 112. The plate no may preferably be of a thickness adapted to facilitate crimping of a pre-rolled cone 800, and preferably a plurality of cones 800, as filling material 810, such as marijuana, is introduced into the cone. After, filling, packing, crimping, and finishing, the pre-rolled cones 800 are extruded through the plate 110 and onto a catcher 850, such as a floor, a tabletop, or a basin. The preferred thickness for the plate 110 is at least 1.5625 inches thick and no more than 1.6875 inches thick when adapted for size 98 mm and 109 mm pre-rolled cones 800. The plate 110 may be made of known materials in the art, such as wood, metal, high-density polyethylene (HDPE), plastic, acrylic, and other moldable and machinable materials.

The plate 110 defines at least one tapered hole 113. The tapered holes 113 are preferably a plurality of tapered holes 113 for this embodiment and the tapered holes 113 are oriented in a pattern of 10 rows. The rows may be offset as shown, they may be arranged into columns, or the tapered holes 113 may be arranged into any other desirable pattern. The tapered holes 113 are wider where they communicate with the working surface 111 and narrows as they extend further away from the working surface 111. The tapered holes 113 receive and hold pre-rolled cones 800 and are preferably designed to hold 98 mm and 109 mm pre-rolled cones 800. Each of the tapered holes 113 correspond to the taper of a pre-rolled cone 800 to facilitate crimping of the pre-rolled cone 800 as the pre-rolled cone 800 is pushed down into the tapered hole 113.

The base 120 attached to the plate 110 may be two legs 120 as illustrated, but another number of legs may be used. The two legs 120 in this embodiment are attached to the plate 110 using screws 122, but other means of attachment known in the art, such as glue, may be used. The embodiment portion shown in FIG. 1A also has handles 121 attached to the legs 120 for easy portability of the apparatus 100. The base 120 holds the plate 110 up in a position sufficiently spaced from the catcher 850 to allow the pre-rolled cones 800 to partially hang out of the corresponding tapered holes 113 while the tapered holes 113 hold the pre-rolled cones 800. The catcher 850 may be any surface that may be used to catch and gather extruded cigarettes, such as a table, a floor, a bin, or a basin. There should be enough space for the extruded cigarette to fall onto, or into, the catcher 850.

The filling materials 810, such as marijuana, from a container means 860 may be poured onto the working surface 111 as illustrated. The rim 112 prevents the filling material 810 from spilling off the plate 110 while the plate 110 is tilted and shaken sideways so the filling material 810 enters into the tapered holes 113 and falls into the pre-rolled cones 800 held within the tapered holes. Packing and crimping devices, and closing and extruding devices are not shown in FIG. 1A-1C, but will be detailed below in FIGS. 2-3 and later FIGS.

Referring specifically to FIG. 1B, there is shown a perspective view of a portion 100 of an embodiment of the pre-rolled cone filling, packing, finishing, and extruding apparatus of FIG. 1A and showing a broken plate 110 segment to show how pre-rolled cones 800 may be received by the tapered holes 113. The left most corner of the plate 110, including some of the rim 112 and the working surface 111, is illustrated as broken to show two tapered holes 113 broken into halves and shown as solid lines within the plate 110. Four of the tapered holes 113 are shown in dotted lines to represent the outline of the tapered holes 113 defined within the plate 110. As described in FIG. 1A, the tapered hole 113 is wider where it communicates with the working surface 111 of the plate 110. Each of the tapered holes 113 correspond to the taper of a pre-rolled cone 800 to facilitate crimping of the pre-rolled cone 800 as the pre-rolled cone 800 is pushed down the tapered hole 113. Two pre-rolled cones 800 are present in two outlined tapered holes 113 to show how each tapered hole 113 would receive and hold a pre-rolled cone 800. As illustrated, each tapered hole 113 is slightly bigger than a pre-rolled cone 800 to allow downward movement of the pre-rolled cone 800 as it is filled, packed, crimped, closed, and extruded from the plate 110. The pre-rolled cones 800 may preferably be of 98 mm size and 109 mm size. Two of the dotted tapered holes 113 are left empty as comparison. A handle 121 attached to the base 120 and the base 120 as two legs 120 attached to the plate 110 are also illustrated to allow easy shaking of this portion 100 of the apparatus to allow better filling of materials 810 on the working surface 111 and into the pre-rolled cones 800.

Referring specifically to FIG. 1C, there is shown atop view of the portion 100 of the embodiment of the pre-rolled cone filling, packing, finishing, and extruding apparatus of FIGS. 1A and 1B. The portion 100 of the apparatus of FIGS. 1A and 1B has a plate 110, a working surface 111, and a rim portion 112. A base 120, comprising two legs 120 in this embodiment, is attached to the plate 110, using screws 122. However, other means of attachment, such as glue, may be used. The two legs 120 are shown each with a handle 121 for easy positioning and moving of the portion 100 of the apparatus, but it will be appreciated that handles could also be attached directly to the plate no. As discussed in connection with FIGS. 1A and 1B, the plate 110 defines 100 tapered holes 113 in a pattern oriented in 10 rows for this embodiment. As shown in FIG. 1C, the leftmost two columns of tapered holes 113 each receives and holds a pre-rolled cone 800 filled with the filling material Bio (shaded gray), which preferably may be marijuana. The next four columns of tapered holes 113 to the right are each shown having received and holding a pre-rolled cone 800 to illustrate how pre-rolled cones 800 may be received and held in the tapered holes 113. The four rightmost columns of tapered holes 113 are empty to illustrate the tapering of the tapered holes 113.

Referring to FIG. 2A, there is shown a side view of an embodiment of a packing and crimping device 130 of a pre-rolled cone filling, packing, finishing, and extruding apparatus in accordance with one or more aspects of the disclosure. The packing and crimping device 130 comprises a handle 131 attached to at least one thin rod 132, which is a plurality of thin rods 132 for this embodiment. The thin rods 132 may be attached to the handle 131 by inserting the thin rod 132 into hollowed out areas of the handle 131 and securing by fastener means 133 as shown in FIG. 2A. However, other means of attachment known in the art, such as glue or force fit, may be used. The embodiment shown in FIG. 2A has 20 thin rods 132 oriented in a pattern of two rows, and it is meant to be used with a plate 110 having tapered holes 113 oriented in a pattern of at least two rows. For example, this embodiment of the packing and crimping device 130 may be used with the 10-row plate 110 of FIGS. 1A-1C. Thin rods 132 may preferably be made of metal, but other materials, such as plastic, may be used. The handle 131 may be made of known materials in the art, such as wood, metal, HDPE, plastic, acrylic, and other moldable and machinable materials.

FIG. 2B is a side view of another embodiment of a packing and crimping device 130' portion of a cigarette manufacturing apparatus in accordance with one or more aspects of the disclosure. The packing and crimping device comprises a handle 131' attached to at least one thin rod 132' that are a plurality of thin rods 132' oriented in a pattern of a row for this embodiment. The handle 131' may be made of known materials in the art, such as known materials in the art, such as wood, metal, HDPE, plastic, acrylic, and other moldable and machinable materials. The plurality of thin rods 132' in this embodiment are 10 thin rods 132' that are each comprised of a spring 134' and a plastic tip 135'. Each spring 134' attaches interposed and interconnecting between the handle 131' and the plastic tip 135'. The spring 134' may be attached to the handle 131' by attachment means known in the art, such as glue or embedding the end of the spring 134' into the handle 131'. The spring 134' may preferably be of diameter big enough for the plastic tip 135' to be inserted and held secure within the spring 134'. Other means of attaching the plastic tip 135' to the spring 134' known in the art, such as glue, may be used. The spring 135' portion of the thin rod 132' allows more delicate placement of the thin rod 132' within a tapered hole (not shown) and within a pre-rolled cone (not shown). The spring 135' also allows for flexibility in action for the plastic tip 135' of the thin rod 132' to easily move in a circular pattern when the packing and crimping device 130' fills and crimps a pre-rolled cone 800. It will be appreciated the handle 131' and thin rods 132' will be constructed, for example possibly with a plurality of pieces combined in such a way as to partially enclose the thin rods, and for example bolts similar to bolts 133 of FIG. 2A, and in a way that will lend structural strength to the device needed in order to withstand pressures of tamping, packing, and crimping as contemplated herein. The packing and crimping device 130' is adapted for use with the apparatus 100 of FIGS. 1A-1C. However, the packing and crimping device 130' may be used with any other embodiment of the apparatus 100 that has at least 10 tapered holes (not shown) in a row, such as the apparatus 100' of FIG. 12.

FIG. 3 is a partially-exploded side view of an embodiment of a closing and extruding device 140 in accordance with one or more aspects of the disclosure, with a portion of the handle 141 shown broken out, as well as with dotted lines, to show how the plurality of tubes 142 attach to the handle 141. It will be appreciated that the handle 141 may be comprised of a plurality of pieces combined in such as a way to partially enclose bolts 143 and portions of the tubes 142. The closing and extruding device 140 comprises a handle 141 attached to at least one tube 142, which may preferably be a plurality of tubes 142. In this embodiment, the plurality of tubes 142 are 10 tubes 142. Each of the tubes 142 is attached to the handle 141 by a bolt 143 with a shaft 144 that is inserted within the tube 142 in order to give the device structural strength to withstand pressing and extruding pressures. The length of the shaft 144 of the bolt 143 may preferably be 1-2 millimeters shorter than the length of the tube 142. The bolt 143 may be made of metal, such as stainless steel, but other materials known in the art, such as plastic or acrylic, may be used. The bolt 143 may attach to the handle 141 by inserting the bolt 143 and tube 142 combination into a hollow 146 within the sleeve that fits tightly around the bolt 143 and the tube 142 combination. Other means of attachment known in the art, such as glue, may be used.

Each of the tubes 142 are designed to be of a larger diameter than the thin rods (shown in FIGS. 2A and 2B) and has a concaved tip 145, which allows for catching and closing of crimped upper edges of pre-rolled cones (not shown). The tube 142 may preferably be made of plastic, such as Nylon, or any other material such as wood, metal, aluminum, or the like, suitable to the purpose of being sufficiently rigid to be used to push and compress the filled pre-rolled cones out of the plate, as shown in FIGS. 1A-1C, and through the tapered hole as shown in FIGS. 1A-1C. The handle 141 may be made of known materials in the art, such as wood, metal, HDPE, plastic, acrylic, and other moldable and machinable materials.

FIG. 4 is a close-up longitudinal cross-section side view of a tapered hole 113 in a plate 110 of an embodiment of a pre-rolled cone filling, packing, finishing, and extruding apparatus in accordance with one or more aspects of the disclosure. The tapered hole 113 is wider where the tapered hole 113 communicates with the working surface 111 of the plate 110. The tapered hole 113 is shown holding a pre-rolled cone 800 filled with filling material 810, marijuana 810 in this illustration, within the plate 110. The circular dotted line within the pre-rolled cone 800 represents the top of the filling material 810 that has filled the pre-rolled cone 800. The portion of the pre-rolled cone 800 above the circular dotted line is the upper edge 801 of the pre-rolled cone that will be crimped as shown in FIG. 5. A thin rod 132 of a packing and crimping device 130 is shown inserted into the pre-rolled cone 800 and standing above the top of the filling material 810, in a position ready to start the packing and crimping process once the pre-rolled cone has been filled. The thin rod 132 is attached to a handle 130.

A thin rod of a combination packing, crimping, closing, and extruding device 230, 230" (shown in FIG. 8 and FIG. 11) of an embodiment of a pre-rolled cone filling, packing, finishing, and extruding apparatus 200, 200', 200" (shown in FIGS. 9-11) in accordance with one or more aspects of the disclosure would work the same as the thin rod 132 of the packing and crimping device 130 shown in FIG. 4 at this stage of filling, packing, and finishing (crimping).

FIG. 5 is a close-up longitudinal cross-section side view of a tapered hole 113 of an embodiment of a plate no of a pre-rolled cone filling, packing, finishing, and extruding apparatus in accordance with one or more aspects of the disclosure, and represents a continuation of the filling, packing, closing, and extruding apparatus (and associated method as described hereinafter) started in FIG. 4. The tapered hole 113 is wider where the tapered hole 113 communicates with the working surface 111 of the plate 110. The tapered hole 113 is shown holding a pre-rolled cone 800 filled with filling material 810, marijuana, within the plate 110. The circular dotted line within the pre-rolled cone 800 represents the top of the filling material 810 that has filled the pre-rolled cone. The portion of the pre-rolled cone 800 above the circular dotted line is the upper edge 801 of the pre-rolled cone.

In FIG. 5, a thin rod 132 of a packing and crimping device 130 is shown inserted into the pre-rolled cone 800. The thin rod 132 is attached to a handle 130. As an operator moves the handle 130 and pushes and moves the thin rod 132 in a circular pattern repeatedly within the pre-rolled cone 800, marijuana 810 will begin to pack. As marijuana 810 is pushed down the body of the pre-rolled cone by the motion, marijuana 810 will stick to the side and the upper edge 801 of the pre-rolled cone and will tend to pull the upper edge down towards the top of the material represented by the dotted circular line. Thus this portion of the process must be gently repeated in a circular up and down motion away from the sides of the paper at first to avoid too early of crimping of the pre-rolled cone. As the repeated circular pattern motion and the pressure from the operator starts to push the pre-rolled cone 800 down into the tapered hole 113 (after filling has been completed and initial crimping of the pre-rolled cone is now desired), the gradual narrowing of the tapered hole 113 will cause the upper edge 801 of the pre-rolled cone to come closer together. As the pre-rolled cone 800 continues to move down the tapered hole 113, the stickiness of the marijuana 810 will cause the ever-closer upper edge 801 to crimp into a crimped edge 802.

A thin rod 232, 232" (shown in FIG. 8 and FIG. 11) of a combination packing, crimping, closing, and extruding device 230, 230" (shown in FIG. 8 and FIG. 11) of a portion of an embodiment of a pre-rolled cone filling, packing, finishing, and extruding apparatus (portions of which are shown in FIGS. 9-10, and the entire apparatus of which is shown in FIG. 11) in accordance with one or more aspects of the disclosure would work the same as the thin rod 132 of the packing and crimping device 130 shown in FIG. 4 at this stage of the filling, packing, and finishing operation. However, as the pre-rolled cone 800 is pushed further into the tapered hole 113, 213, 213', 213" of the apparatus portion 200, 200', 200" and an operator puts more pressure into the handle 231, 231", of the combination packing, crimping, closing, and extruding device 230, 230", the spring 234 above the thin rod will start to compress and portions of the thin rod 232, 232" will be pulled up into the tube 242, 242" until the spring is maximally compressed and the tube is engaged.

FIG. 6 is a close-up longitudinal cross-section side view of a tapered hole 113 of a plate 110 of an embodiment of a pre-rolled cone filling, packing, finishing, and extruding apparatus in accordance with one or more aspects of the disclosure, and an extruding portion continuation of the filling, packing, and closing, portions illustrated in FIGS. 4 and 5. The tapered hole 113 is wider where the tapered hole 113 communicates with the working surface 111 of the plate 110. The tapered hole 113 is shown holding a pre-rolled cone 800 filled with filling material 810, marijuana, within the plate 110. The circular dotted line within the pre-rolled cone 800 represents the top of the filling material 810 that has filled the pre-rolled cone. The portion of the pre-rolled cone 800 above the circular dotted line is the upper edge 801 of the pre-rolled cone.

A tube 142 of a closing and extruding device 140 is shown pressing against the now packed pre-rolled cone 800. The tube 142 is attached to a handle 140. The tube 142 is thicker in diameter than the diameter of the thin rod 132 (shown in FIGS. 4 and 5) and has a concaved tip 145, thereby easily catching onto the crimped edge 802 of the pre-rolled cone 800. Pushing of the tube 142 into the tapered hole 113 causes the crimped edge 802 of the pre-rolled cone 800 to catch and fold down. As the operator continues to push the tube 142 onto the pre-rolled cone 800 within the tapered hole 113, the motion causes all the folds of the crimped edge 802 to close and to be compacted into a closed top 803. The pushing of the tube 142 against the pre-rolled cone 800 also moves the pre-rolled cone further down into the tapered hole 113, getting it ready for an extrusion phase.

A tube 242, 242" of a combination packing, crimping, closing, and extruding device 230, 230" (shown in FIG. 8 and FIG. 11) of an embodiment of a pre-rolled cone filling, packing, finishing, and extruding apparatus (a portion of which is shown in FIGS. 9-10, and the entire apparatus of which is shown in FIG. 11) in accordance with one or more aspects of the disclosure would work the same as the tube 142 of the closing and extruding device 140 shown in FIG. 6 at this extruding stage of the operation. As discussed, the spring 234 should be maximally compressed, sliding the thin rod 232, 232" upwardly such that the tube should be engaged and ready for usage at this extruding phase of the operation.

FIG. 7 is a close-up longitudinal cross-section side view of a tapered hole 113 of a plate 110 of an embodiment of a pre-rolled cone filling, packing, finishing, and extruding apparatus in accordance with one or more aspects of the disclosure, and there is shown an apparatus portion for continuation in an extruding method portion of the filling, packing, and closing method portions illustrated in FIGS. 4-6. The tapered hole 113 is wider where the tapered hole 113 communicates with the working surface 111 of the plate 110. A closing and extruding device 140 and its handle 141 and a tube 142 are shown. As the concaved tip 145 of the tube 142 pushes against the now closed pre-rolled cone 800 (not yet extruded as shown in FIG. 6), until the finished cigarette 820 is pushed further down into the tapered hole 113 where finally it is extruded from the tapered hole 113 and the plate 110 onto, or into, the catcher 850. In FIG. 7, the tube 142 has been pushed all the way into the tapered hole 113 with sufficient force to push and extrude the finished cigarette 820 onto the catcher 850, which may preferably be a flat surface such as a tabletop. The finished cigarette 820 thus extruded is ready for immediate user consumption by smoking.

A tube 242, 242" (shown in FIG. 8 and FIG. 11) of a combination packing, crimping, closing, and extruding device 230, 232" (shown in FIG. 8 and FIG. 11) of an embodiment of a pre-rolled cone filling, packing, finishing, and extruding apparatus (a portion of which is shown in FIGS. 9-10, and the entire apparatus of which is shown in FIG. 11) in accordance with one or more aspects of the disclosure would work the same as the tube 142 of the closing and extruding device 140 shown in FIGS. 6 and 7.

FIG. 8 is a side view of a combination packing, crimping, closing, and extruding device 230 having at least one thin rod 232 of a plurality of thin rods 232, and having at least one tube 242 of a plurality of tubes 242 in accordance with one or more aspects of the disclosure. The plurality of thin rods 232 and the plurality of tubes 242 are 10 thin rods 232 and 10 tubes 242 oriented in a row for this embodiment. The combination packing, crimping, closing, and extruding device 230 is shown partially broken out at the leftmost portion of the handle 231 to show the internal structure and workings of the combination packing, crimping, closing, and extruding device 230.

Each of the thin rods 232 is thinner than each of the corresponding tubes 242, and each thin rod 232 is adapted to reside partially within a corresponding tube 242. The handle 231 has a hollow space 246 for each of the thin rod 232 and tube 245 combination. A spring 234 resides within the hollow space 246 and connects with a head 244 of a thin rod 232. The spring 234 allows the thin rod 232 to slide upwards and into the corresponding tube 242 as the spring 234 is compressed, as described in FIG. 6. This compressing and sliding of the thin rod 232 allows for exposure of the concaved tip 245 of the corresponding tube 242 for usage. The spring 234 may attach to the head 244 of the thin rod 232 and the handle 231 by force fit, welding, glue or any other attachment means known in the art. The spring 234 may also be freely held within the hollow space 246 without any attachment to either the head 244 of the thin rod 232 or the handle 231, such as would be the case if a union nut and threaded collar 243 were to hold the assembly in the hollow space. A tube 242 may preferably be attached to the handle 231 by a union nut 243. The tube 242 may be glued, threaded, welded, or otherwise fitted into the union nut 243 to be held in place. Other methods of attaching the tube 242 to the union nut 243 known in the art may be used. The union nut 243 may be stainless steel, but other materials known in the art may be used. The thin rods 232 may preferably be made of metal, but other materials, such as plastic, may be used. The tubes 242 may preferably be made of plastic, such as Nylon, or any other material such as wood, metal, aluminum, or the like, suitable to the purpose of being sufficiently rigid to be used to push and compress the filled pre-rolled cones 800 out of the plate 110 through the tapered holes 113. The handle 231 may be made of known materials in the art, such as wood, metal, HDPE, plastic, acrylic, and other moldable and machinable materials.

As illustrated, the leftmost portion of the handle 231 is broken out to show the hollow 246 within the handle 231 and to illustrate how a spring 234, a thin rod 232, union nut 243, and a tube 242 are attached to the handle 231. The second leftmost hollow 246, spring 234, head portion of the thin rod 232, and a portion of the union nut 243 are shown in dotted lines to outline how these parts would be held internally within the handle 241. The third leftmost is a broken apart exploded view of the spring 234, the thin rod 232, the union nut 243, and the tube 242 to illustrate how different parts are assembled.

The embodiment of combination packing, crimping, closing, and extruding device 230 in FIG. 8 has 10 thin rods 232 and its corresponding tubes 242 oriented in a pattern of one row, meant to be used with a plate 110 having tapered holes 113 oriented in a pattern of at least one row. For example, this embodiment of the combination packing, crimping, closing, and extruding device 230 may be used with the 10 row plate 210 of FIGS. 9 and 10. The dotted lines are to show how the handle 231 attaches the tubes 242, the thin rods 232, and the springs 234.

FIG. 9 is a perspective view of a portion 200 an embodiment of a pre-rolled cone filling, packing, finishing, and extruding apparatus in accordance with one or more aspects of the disclosure, with at least one tapered hole 213 preferably being a plurality of tapered holes 213. The portion 200 of the pre-rolled cone filling, packing, finishing, and extruding apparatus comprises a plate 210, a working surface 211, an extrusion surface 214, and a rim portion 212. The plate 210 may preferably be of a thickness adapted to facilitate crimping of a pre-rolled cone 800 as filling material 810, such as marijuana, is introduced into the pre-rolled cone and the pre-rolled cone is extruded through the plate 210. The preferred thickness for the plate 210 is at least 1.5625 inches thick and no more than 1.6875 inches thick. The plate 210 may be made of known materials in the art, such as wood, metal, HDPE, plastic, acrylic, and other moldable and machinable materials. At least one tapered hole 213 is preferably comprised of a plurality of tapered holes 213, as shown in this embodiment, which are oriented in a pattern of 10 rows. The tapered holes 213 are widest where they communicate with the working surface 211 and narrowest where they communicate with the extrusion surface 214. The tapered holes 213 receive and hold pre-rolled cones 800 and are preferably designed to hold 98 mm and 109 mm pre-rolled cones. Each of the tapered holes 213 correspond to the taper of a pre-rolled cone 800 to facilitate crimping of the pre-rolled cone as the pre-rolled cone is pushed down the tapered hole 213.

The base 220 attached to the plate 210 may be two legs 220 as illustrated, but other number of legs may be used. The two legs 220 differ in shape from the base 120 shown in FIGS. 1A-1C to show how different types of base 120, 220 may be used for the embodiments of the apparatus 100, 200. The base 220 should hold the plate 210 up in a position sufficiently spaced from the catcher 850 to allow pre-rolled cones 800 to partially hang out of the tapered holes 213 while the tapered holes 213 hold the pre-rolled cones. The catcher 850 may be any surface that may be used to catch and gather extruded cigarettes 820, such as a tabletop, a floor, or other catch basin. There should be enough space for the extruded cigarette 820 to fall onto the catcher 850. In this embodiment, the two legs 220 are attached to the plate 220 by screws 222, but other means of attachment known in the art, such as for example welding, may be used.

FIG. 10 is a perspective view of a portion 200' of an embodiment of a pre-rolled cone filling, packing, finishing, and extruding apparatus in accordance with one or more aspects of the disclosure, with at least one tapered hole 213' being a plurality of tapered holes 213' oriented in a pattern of 10 rows and a base 220' comprised of four legs 220'. The portion 200' of a pre-rolled cone filling, packing, finishing, and extruding apparatus comprises a plate 210', a working surface 211', an extrusion surface 214', and a rim 212'. The portion 200' is the same in every aspect as the portion 200 of FIG. 9 except for the number of legs 220'. The four legs 220' are attached to the plate 210' using screws 222', but other means of attachment known in the art, such as glue or welding, may be used.

FIG. 11 is a perspective view of an embodiment of a pre-rolled cone filling, packing, finishing, and extruding apparatus, comprising portion 200" (comprising a plate 210" and base/legs 220") and portion 230" (comprising a combination packing, crimping, closing, and extruding device 230"), in accordance with one or more aspects of the disclosure. The plate 210" of portion 200" defines a single tapered hole 213", and the base 220" is comprised of two legs 220". Further, the plate 210" of the portion 200" of the pre-rolled cone filling, packing, finishing, and extruding apparatus further comprises a working surface 211", an extrusion surface 214", and a rim 212". The plate 210" may preferably be of a thickness adapted to facilitate crimping of a pre-rolled cone 800 (see FIG. 1A) as filling material 810, such as marijuana, is introduced into the pre-rolled cone and the pre-rolled cone is extruded through the plate. The preferred thickness for the plate 210" is at least 1.5625 inches thick and no more than 1.6875 inches thick. The plate 210" may be made of known materials in the art, such as wood, metal, HDPE, plastic, acrylic, and other moldable and machinable materials. The tapered hole 213" is widest where it communicates with the working surface 211" and narrowest where it communicates with the extrusion surface 214". The tapered hole 213" receives and holds pre-rolled cone 800 and is preferably designed of a size to readily hold 98 mm and 109 mm pre-rolled cones. The tapered hole 213" thus corresponds to the taper of a pre-rolled cone 800 and facilitates crimping of the pre-rolled cone as it is pushed down the tapered hole 213".

The base 220" attached to the plate 210" may be two legs 220" as illustrated, but another number of legs may be used without departing from the scope and spirit of the invention as claimed. The base 220" should hold the plate 210" up in a position sufficiently spaced from the catcher 850" to allow a pre-rolled cone to partially hang out of the tapered hole 213" while the tapered hole holds it. The catcher 850" may be any surface that may be used to catch and gather an extruded cigarette, and may comprise a tabletop, a floor, a catch basin, or other similar device. Accordingly, there should be enough space for the extruded cigarette to fall onto the catcher 850". In this embodiment, the two legs 220" are attached to the plate 220" by welding, or glue, but other means of attachment known in the art may be used.

FIG. 11 also illustrates a combination packing, crimping, closing, and extruding device 230" portion of a cigarette manufacturing apparatus in accordance with the invention and which is comprised of one thin rod 232" and one tube 242" attached to a handle 231". The thin rod 232" is thinner than the inside and outside diameters of the tube 242", and the thin rod 232" is adapted to reside partially within the tube 242". The handle 231" has a hollow space for the thin rod 232" and tube 245" combination as described similarly in connection with FIG. 8. A spring 234" not shown resides within the hollow 246 (not shown) and connects with a head 244" (not shown) of the thin rod 232" similarly to that described in connection with FIG. 8. The spring allows the thin rod 232" to slide upwards and into the tube 242" as the spring is compressed, as described in FIG. 8. This compressing and sliding of the thin rod 232" allows for exposure of the concaved tip 245" of the tube 242" for usage as previously described to finish and extrude the cigarette 820. The tube 242" may preferably be attached to the handle 231" by a union nut 243". The tube 242" may be glued, or otherwise fitted onto the union nut 243" to be held in place. Other methods of attaching the tube 242" to the union nut 243" known in the art may be used. The thin rod 232" may preferably be made of metal, but other materials, such as plastic, may be used. The tube 242" may preferably be made of plastic, such as Nylon, or any other material such as wood, metal, aluminum, or the like, suitable to the purpose of being sufficiently rigid to be used to push and compress the filled pre-rolled cones 800 out of the plate 210" through the tapered hole 213". The union nut 243" may be made of stainless steel any other materials known in the art suitable to the purpose of such to interconnect the tube 242" and thin rod 232" to the handle 231". The handle 231" may be made of known materials in the art, such as wood, metal, HDPE, plastic, acrylic, and other moldable and machinable materials.

FIG. 12 is a perspective view of an embodiment of a portion 100' of a pre-rolled cone filling, packing, finishing, and extruding apparatus in accordance with one or more aspects of the disclosure, with a plurality of tapered holes 113' defined by a plate 110' and oriented in a pattern of a row, together with a base 120' comprised of two legs 120'. The plate 110' of the pre-rolled cone filling, packing, finishing, and extruding apparatus comprises a working surface 111', and a rim 112'. The plate 110' may preferably be of a thickness adapted to facilitate crimping of a pre-rolled cone 800 (see FIG. 1A) as filling material 810 such as marijuana, is introduced into the pre-rolled cone (not shown) and the pre-rolled cone (not shown) is extruded through the plate 110'. The preferred thickness for the plate 110' is at least 1.5625 inches thick and no more than 1.6875 inches thick. The plate 110' may be made of known materials in the art, such as wood, metal, HDPE, plastic, acrylic, and other moldable and machinable materials. The tapered holes 113' are wider where they communicate with the plate's working surface 111', and the tapered holes become narrower where they communicate with a lower extrusion surface at the bottom of the plate 110'. The tapered holes 113' are adapted to receive and hold pre-rolled cones 800 and are preferably designed to hold 98 mm and 109 mm pre-rolled cones. Each of the tapered holes 113' correspond to the taper of a pre-rolled cone 800 to facilitate crimping of the pre-rolled cone as it is pushed down each respective corresponding tapered hole.

The base 120' attached to the plate 110' may be comprised of two legs 120' as illustrated, but another number of legs may be used as will be appreciated by those of skill in the art. The base 120' should hold the plate 110' up in a position sufficiently spaced from the catcher 850' to allow pre-rolled cone 800 to partially hang out of the tapered holes 113' while the tapered holes hold corresponding pre-rolled cones. The catcher 850' may be any surface that may be used to catch and gather an extruded cigarette 810 (see FIG. 7), such as a tabletop, a floor, or other catch basin. There should be enough space for the extruded cigarette 820 to fall onto the catcher 850'. In this embodiment, the two legs 120' are attached to the plate 120' by welding, by glue, by screws, or other means of attachment known in the art.

It will be appreciated that in accordance with an aspect and embodiment of the disclosure, each of the at least one tapered holes defined in the plate is adapted to correspond to the taper of a pre-rolled cone, whether of a 98 mm size, or a 109 mm size, such that when the packing and crimping device gently packs each pre-rolled cone with filling material such as marijuana, each pre-rolled cone is packed but is preferably not yet pushed further into the pre-rolled cones' respective tapered holes. This pushing, or extruding, ideally doesn't happen until a later step than the filling and packing steps are completed so that additional material may be filled into the pre-rolled cone before an upper edge of the paper of the cone gets crimped—which crimp would prevent further material (such as marijuana) from getting into the cones. Once each pre-rolled cone is completely filled and packed, it is ready to be finished and extruded. Thus, it will thus be appreciated that the packing and crimping/finishing device is first used gently to pack each pre-rolled cone with material without first crimping the upper edge of each pre-rolled cone, since doing so may prevent further filling of the cones if necessary. After filling and gentle packing is completed, some initial crimping may be imparted by the packing and crimping device since the stickiness of the marijuana being packed into the pre-rolled cone with the packing and crimping device causes some crimping. And this is why packing must be done gently to prevent too early of crimping. After completion using the packing and crimping/finishing device, the closing and extruding device is then applied to each tapered hole having a filled and packed pre-rolled cone therein, the closing and extruding device thus being used to push each pre-rolled, filled, and packed cone further into its respective tapered hole. This latter process, known as extruding, causes each pre-rolled cone to begin to crimp further in earnest—or further crimp as some initial crimping has already begun with the filling and packing process (due to the stickiness of the marijuana pulling the paper inwardly with use of the packing and crimping/finishing device). And as each filled and packed pre-rolled cone is pushed further into its respective tapered hole using the closing and extruding device, the upper edge of each pre-rolled cone is folded further inwardly. In other words, as each pre-rolled cone is pushed further into its tapered hole with the closing and extruding device, they further close, they are extruded (compacted) until each pre-rolled cone is simultaneously pushed further and further into its respective tapered hole, and they are still further extruded until each finished cigarette is finally pushed out onto, or into, the catcher.

Thus, in accordance with an aspect of the disclosure, there is provided a pre-rolled cone finishing and extruding method for filling, packing, finishing, and extruding cigarettes, such as marijuana cigarettes, onto, or into, a catcher, is comprised of:

Step A: obtaining a pre-rolled cone filling, packing, finishing, and extruding apparatus with a plate comprising a working surface and a rim portion, and the plate defining a plurality of tapered holes communicating with the working surface, wherein the plurality of tapered holes are wider where each tapered hole communicates with the working surface of the plate, the plate adapted to receive and hold a plurality of pre-rolled cones into the plurality of tapered holes, a base attached to the plate, wherein the base is sufficiently spaced from the catcher to allow the plurality of pre-rolled cones received by the plurality of tapered holes to be suspended at least sufficiently spaced from the catcher to allow for extruding of the plurality of finished cigarettes onto, or into, the catcher, a packing and crimping device having a handle attached to at least one thin rod adapted to fill, pack and crimp a corresponding plurality of pre-rolled cones within the plurality of tapered holes, and a closing and extruding device having a handle attached to at least one tube that is thicker (e.g., has a larger diameter) than the at least one thin rod, and is adapted to close the plurality of pre-rolled cones and extrude finished cigarettes from within the plurality of tapered holes;

Step B: placing a plurality of pre-rolled cones into the plurality of tapered holes in the plate;

Step C: pouring the filling material, such as marijuana, for the plurality of pre-rolled cones onto the working surface of the plate such that the filling material is contained within the working surface by the rim portion of the plate;

Step D: shaking and tilting the plate to guide the filling material into the plurality of pre-rolled cones held in the plurality of tapered holes;

Step E: repeating steps B through D until the plurality of pre-rolled cones are filled;

Step F: inserting each thin rod of the packing and crimping device into the plurality of tapered holes with the plurality of pre-rolled cones and moving each thin rod of the packing and crimping device in a gentle up and down circular pattern repeatedly within the plurality of tapered holes (but in the center of each hole at first away from the pre-rolled paper cone edges) to pack the marijuana into the plurality of pre-rolled cones;

Step G: continuing the up and down circular pattern closer to the pre-rolled paper cone edges causing the upper edge of each pre-rolled cone to crimp inwardly as the pressure from each thin rod begins, with more pressure applied to push each pre-rolled cone slightly further into each corresponding tapered hole to bring the upper edge of each pre-rolled cone inwardly and such that the stickiness of the marijuana also pulls the upper edge of each pre-rolled cone inwardly;

Step H: inserting each tube of the closing and extruding device into corresponding tapered holes, and pushing the crimped end of each pre-rolled cone to fold to close off the pre-rolled cone; and Step I: exerting further pressure onto the closing and extruding device having tubes located in corresponding tapered holes, to extrude the plurality of finished cigarettes out of the plurality of tapered holes and onto, or into, the catcher.

In accordance with another aspect and embodiment of the disclosure, a pre-rolled cone finishing and extruding method for filling, packing, finishing, and extruding cigarettes, such as marijuana cigarettes, onto a catcher, is comprised of the following steps:

Step A: obtaining a pre-rolled cone filling, packing, finishing, and extruding apparatus with a plate comprising a working surface and a rim portion, and the plate defining a plurality of tapered holes communicating with the working surface, wherein the plurality of tapered holes are wider where each tapered hole communicates with the working surface of the plate, the plate adapted to receive and hold a plurality of pre-rolled cones into the plurality of tapered holes, a base attached to the plate wherein the base is sufficiently spaced from the catcher to allow the plurality of pre-rolled cones received by the plurality of tapered holes to be suspended at least sufficiently spaced from the catcher to allow for extruding of the plurality of finished cigarettes, and a combination packing, crimping, closing, and extruding device having a handle attached by means of at least one spring to a corresponding at least one thin rod adapted to fill and crimp a corresponding plurality of pre-rolled cones within the plurality of tapered holes, the handle also being attached to at least one hollow tube within which each corresponding thin rod partially resides, each hollow tube's inner and outer diameters being wider than each corresponding thin rod and adapted to close and extrude the finished cigarettes from within the plurality of tapered holes;

Step B: placing a plurality of pre-rolled cones into the plurality of tapered holes in the plate;

Step C: pouring the filling material, such as marijuana, for the plurality of pre-rolled cones onto the working surface of the plate such that the filling material is contained within the working surface by the rim portion of the plate;

Step D: shaking and tilting the plate to guide the filling material into the plurality of pre-rolled cones in the plurality of tapered holes;

Step E: repeating steps B through D until the plurality of pre-rolled cones are filled;

Step F: inserting each thin rod of the combination packing, crimping, closing, and extruding device into the plurality of tapered holes with the plurality of pre-rolled cones and moving the at least one thin rod of the combination packing, crimping, closing, and extruding device around in a gentle up and down circular pattern repeatedly within the plurality of tapered holes (but in the center of each hole at first away from the pre-rolled paper cone edges) to pack the marijuana into the plurality of pre-rolled cones;

Step G: continuing the up and down circular pattern closer to the pre-rolled paper cone edges causing the upper edge of each of the plurality of pre-rolled cones to crimp inward as the pressure from the at least one thin rod begins, with more pressure applied to push each of the plurality of pre-rolled cones slightly further into each of the corresponding plurality of tapered holes to bring the upper edge of each the plurality of pre-rolled cones inwardly and such that the stickiness of the marijuana also pulls the upper edges of the plurality of pre-rolled cones inwardly;

Step H: pushing down further so as to cause the at least one tube of the combination packing, crimping, closing, and extruding device and pushing the crimped end of each of the plurality of pre-rolled cones to fold to close off the plurality of pre-rolled cones; and Step I: exerting further pressure onto the combination packing, crimping, closing, and extruding device to extrude the plurality of finished cigarettes out of the plurality of tapered holes and onto, or into, the catcher.

One of ordinary skill in the art will recognize the inventive principles disclosed are not limited to the embodiments disclosed herein, and that various aspects of the disclosed embodiments may be combined to achieve additional embodiments.

In the preceding description, numerous details were set forth. It will be apparent, however, to one skilled in the art, that the present invention may be practiced without some of these specific details. Additionally, one of ordinary skill in the art will recognize the inventive principles disclosed are not limited to the embodiments disclosed herein, and that various aspects of the disclosed embodiments may be combined to achieve yet additional embodiments. In some instances, well-known structures and devices are shown in block diagram form, rather than in detail, in order to avoid obscuring the present invention.

The pre-rolled cone filling, packing, finishing, and extruding apparatus and methods of the present disclosure address problems with prior art apparatus and methods of filling, packing, finishing, and extruding cigarettes, especially marijuana cigarettes. This is because the present apparatus and methods help to alleviate the problem of quickly mass processing marijuana into a plurality of cigarettes without using complex machinery. Thus, the present apparatus and methods will enhance the making of a plurality marijuana cigarettes for immediate consumption by smoking by providing means that are inexpensive, portable, one person operated, convenient, fast, and easy. Further, it will be appreciated that the present invention may be adapted to non-human mechanical mass production means, comprising a similar plate having a rim and defining tapered holes, together with a base, a packing, finishing, closing, and extruding device, or devices, all operated using machine based pouring and shaking techniques, as with cams to facilitate filling, and robotic arms or booms to facilitate packing, finishing, and extruding of cigarettes, all without departing from the scope and spirit of the invention as claimed. Thus, while a preferred embodiment of the present disclosure has been shown and described, it will be apparent to those skilled in the art that many changes and modifications may be made without departing from the claimed subject matter in its broader aspects. For example, it will be appreciated that one of ordinary skill in the art may mix and match the various components of the various embodiments of the claimed subject matter without departing from the true spirit of the claims. The appended claims are therefore intended to cover all such changes and modifications as fall within the true spirit and scope of the invention.

What is claimed is:

1. A pre-rolled cone filling, packing, finishing, and extruding apparatus, adapted for making and extruding cigarettes, comprising a smokable material, comprising:

a plate comprising a working portion, a rim portion, and an extruding portion for extruding the cigarette through to close, said plate defining at least one tapered hole communicating with the working portion, wherein the tapered hole is wider where it communicates through the working portion of said plate, and narrower where it communicates through the extruding portion of said plate, said plate adapted to receive and hold a pre-rolled cone into the tapered hole;

a catcher adapted to catch and gather extruded cigarettes;

a base attached to said plate wherein said base further comprises at least one leg adapted for holding said plate spaced from said catcher to allow each pre-rolled cone received through the tapered hole to be suspended and to partially hang out of the tapered hole while the tapered hole holds the pre-rolled cone spaced from said catcher and to allow for extruding of the cigarette through the tapered hole and through the extruding portion of said plate for fall onto said catcher;

a packing and crimping device comprising a handle having at least one thin rod attached to the handle and adapted to be brought into alignment with the tapered hole to pack and to begin to fold over and to create a crimped upper edge of the pre-rolled cone within the tapered hole; and a closing and extruding device comprising a handle having at least one tube comprising a concaved tip and extending from the handle, wherein the outer diameter of the tube's concaved tip is larger than the thin rod of said packing and crimping device to enable catching and folding down the crimped upper edge of the pre-rolled cone by the at least one tube, said closing and extruding device being adapted for being brought into alignment with the tapered hole for closing and extruding the packed and crimped pre-rolled cone to become a cigarette as the cigarette passes through said plate and onto said catcher, the tube being adapted for pushing of the pre-rolled cone down the tapered hole to further compact the smokable material into the pre-rolled cone and to further fold over inwardly the upper edge of the pre-rolled cone to close the pre-rolled cone into the cigarette having a closed top as the cigarette extrudes through the extrusion surface of said plate.

2. The apparatus of claim 1, wherein said plate is of a thickness adapted to facilitate crimping of a pre-rolled cone as marijuana is introduced into the pre-rolled cone and the pre-rolled cone is pushed further into the corresponding tapered hole.

3. The apparatus of claim 1, wherein said plate is at least 1.5625 thick and no more than 1.6875 inches thick.

4. The apparatus of claim 3, wherein each of said at least one tapered hole defined in said plate is adapted to correspond to the taper of a pre-rolled cone such that when said packing and crimping device packs each pre-rolled cone with the smokable material, each pre-rolled cone is pushed further into the tapered hole, such that the tapered hole begins to crimp an upper edge of each pre-rolled cone, and such that when said closing and extruding device closes each pre-rolled cone, each pre-rolled cone is simultaneously pushed further into the tapered hole until each cigarette pops out and falls as it extrudes out through the narrower portion of the tapered hole communicating through said plate and onto said catcher.

5. The apparatus of claim 4, wherein the at least one tapered hole comprises a plurality of tapered holes arranged in a pattern communicating through said plate and adapted for receiving a corresponding plurality of pre-rolled cones; wherein the at least one thin rod of said packing and crimping device comprises a plurality of thin rods arranged in a corresponding pattern wherein the plurality of thin rods are adapted to be brought into alignment with the plurality of tapered holes; and wherein at least one tube of said closing and extruding device comprises a plurality of tubes, each tube comprising a concaved tip and arranged in a corresponding pattern wherein the plurality of tubes are adapted to be brought into alignment with the plurality of tapered holes; wherein the outer diameter of the concaved tip of each of said plurality of tubes is larger than the diameter of each of said plurality of thin rods to enable catching and folding down the crimped edges of the pre-rolled cones by the plurality of tubes, and wherein each of the plurality of tubes is adapted for pushing of each cigarette down the tapered hole by the corresponding tube until the cigarette extrudes though the extrusion surface of said plate.

6. The apparatus of claim 4, wherein the at least one tapered hole is a plurality of tapered holes oriented in a pattern of rows and columns and communicating through said plate and adapted for receiving a corresponding plurality of pre-rolled cones, wherein the at least one thin rod of said packing and crimping device comprises a plurality of thin rods oriented in a corresponding pattern wherein the plurality of thin rods are adapted to be brought into alignment with the plurality of tapered holes in at least one row, and wherein said at least one tube of said closing and extruding device comprises a plurality of tubes, each tube comprising a concaved tip and oriented in a corresponding pattern wherein the plurality of tubes are adapted to be brought into alignment with the plurality of tapered holes in at least one row, wherein the outer diameter of the concaved tip of each of the plurality of tubes is larger than the diameter of each of the plurality of thin rods to enable catching and folding down the crimped edges of the pre-rolled cones by the plurality of tubes, and wherein each of the plurality of tubes is adapted for pushing of each cigarette down the tapered hole by the corresponding tube until the cigarette pops out and falls onto said catcher from the location where the tapered hole is narrower and communicates through the extrusion surface of said plate.

7. The apparatus of claim 6 wherein said handle of said combination packing, crimping, closing, and extruding device is HDPE, and wherein said plate is comprised of HDPE.

8. The apparatus of claim 1, wherein said base comprises a plurality of legs adapted for holding said plate spaced from said catcher that is adapted to catch and gather the extruded cigarettes, to allow the pre-rolled cone received through the tapered hole to be suspended and to partially hang out of the tapered hole while the tapered hole holds the pre-rolled cone spaced from said catcher, and to allow for extruding of the cigarette through the tapered hole and through the extruding portion of said plate to fall onto said catcher.

9. The apparatus of claim 1, wherein each of the at least one tube of said closing and extruding device comprises a hollow plastic tube having a concaved tip, wherein each tube attaches to the handle by a shaft inserted into each tube, and wherein each tube is longer than the shaft.

10. The apparatus of claim 1, wherein each at least one thin rod of said packing and crimping device further comprises a spring attached interposed and interconnecting between the handle and each thin rod.

11. The apparatus of claim 1, wherein the handle of said packing and crimping device is high-density polyethylene (HDPE), and wherein said plate is comprised of HDPE.

12. The apparatus of claim 1, wherein the handle of said finishing and extruding device is HDPE, and wherein said plate is comprised of HDPE.

13. A pre-rolled cone filling, packing, finishing, and extruding apparatus, adapted for making and extruding cigarettes comprising a smokable material, comprising:

a plate comprising a working surface, a rim portion, and an extrusion surface, for extruding the cigarette through to close, wherein said plate defines at least one tapered hole communicating through the working surface and the extrusion surface, wherein each tapered hole is wider where it communicates with the working surface of said plate, and wherein each tapered hole tapers to be narrower where it communicates through the extrusion surface of said plate, said plate adapted to receive and hold a corresponding pre-rolled cone into each corresponding tapered hole;

a catcher adapted to catch and gather extruded cigarettes;

a base attached to said plate and comprising legs adapted for holding said plate spaced from said catcher to allow each pre-rolled cone, as adapted to be held and received by each corresponding tapered hole, to be suspended and to partially hang out of the tapered hole while the tapered hole holds the pre-rolled cone spaced from the relative to said catcher and to allow for extruding of corresponding cigarettes onto the catcher; and a combination packing, crimping, closing, and extruding device comprising a handle having at least one thin rod extending from a spring from the handle, each thin rod adapted to pack and crimp a pre-rolled cone retained within its corresponding tapered hole, the handle also having a tube corresponding a concaved tip and corresponding to each thin rod, each tube also extending from the handle, each tube having an inside diameter and an outside diameter at the tube's concaved tip that are each larger than each corresponding thin rod, and wherein each thin rod is adapted to reside partially within a corresponding tube, each thihn rod and corresponding tube being adapted to be brought into alignment with the at least one corresponding tapered hole to enable each thin rod to pack, to begin to fold over, and to create a crimped upper edge at an upper portion of each corresponding pre-rolled cone, and to enable the concaved tip of each corresponding tube to catch and fold down the upper portion of each corresponding pre-rolled cone as each corresponding tube pushes each corresponding pre-rolled cone down its tapered hole to enable closing and extruding of each corresponding pre-rolled cone from the location where the tapered holes are narrower and communicate through the extrusion surface of said plate to create corresponding cigarettes as the corresponding cigarettes pop out through the extrusion surface of said plate onto said catcher.

14. The apparatus of claim 13, wherein said plate thickness is at least 1.5625 inches thick and no more than 1.6875 inches thick.

15. The apparatus of claim 13, wherein each tapered hole is adapted to correspond to the taper of a pre-rolled cone such that when said combination packing, crimping, closing, and extruding device packs each pre-rolled cone with the smokable material, each pre-rolled cone is pushed further into said plate which crimps an upper edge of each pre-rolled cone and such that when said combination packing, crimping, closing, and extruding device closes each pre-rolled cone each pre-rolled cone is simultaneously pushed further into its corresponding tapered hole until the apparatus extrudes, thus transforming each pre-rolled cone and the smokable material therein into cigarettes until each cigarette pops out and falls as it extrudes through the narrower portion of the tapered hole communicating through said plate and onto said catcher.

16. The apparatus of claim 15, wherein the at least one tapered hole is a plurality of tapered holes, wherein said at least one thin rod of said combination packing, crimping, closing, and extruding device comprises a plurality of thin rods that are adapted to align with said plurality of tapered holes; wherein said at least one tube of said combination packing, crimping, closing, and extruding device comprises a plurality of tubes, each tube comprising a concaved tip, and that are adapted to align with said plurality of tapered holes, wherein the outer diameter of the concaved tip of each of said plurality of tubes is larger than the diameter of each of said plurality of thin rods to enable catching and folding down the crimped edges of the pre-rolled cones by the plurality of tubes, and wherein each of said plurality of tubes is adapted for pushing of the corresponding pre-rolled cone down the tapered hole until the corresponding pre-rolled cone becomes the cigarette as the cigarette extrudes through the extrusion surface of said plate.

17. The apparatus of claim 15, wherein the at least one tapered hole is a plurality of tapered holes oriented in a pattern of rows and columns and communicating through said plate and adapted for receiving a corresponding plurality of pre-rolled cones, wherein the at least one thin rod of said combination packing, crimping, closing, and extruding device comprises a plurality of thin rods that align with a plurality of tapered holes in at least one row, wherein said at least one tube of said combination packing, crimping, closing, and extruding device comprises a plurality of tubes, each tube comprising a concaved tip, and that align with a plurality of tapered holes in at least one row, and wherein the outer diameter of the concaved tip of each of said plurality of tubes is larger than the diameter of each of said plurality of thin rods to enable catching and folding down the cimped edges of the pre-rolled cones by the plurality of tubes, each of the plurality of tubes being adapted for pushing of corresponding pre-rolled cones down their corresponding tapered holes until the corresponding pre-rolled cones become cigarettes as they pop out onto the catcher from the location where each corresponding tapered hole is narrower and communicates through the extrusion surface of said plate.

18. The apparatus of claim 13, wherein said base comprises a plurality of legs adapted for holding said plate spaced from said catcher that is adapted to catch and gather the extruded cigarettes, to allow the pre-rolled cone received through the tapered hole to be suspended and to partially hang out of the tapered hole while the tapered hole holds the pre-rolled cone spaced from said catcher, and to allow for extruding of the cigarette through the tapered hole and through the extruding portion of said plate to fall onto said catcher.

* * * * *